US007114575B2

(12) United States Patent
De Anda-Uribe et al.

(10) Patent No.: US 7,114,575 B2
(45) Date of Patent: Oct. 3, 2006

(54) METHOD AND APPARATUS FOR EXTINGUISHING FIRES IN STORAGE VESSELS CONTAINING FLAMMABLE OR COMBUSTIBLE LIQUIDS

(75) Inventors: Victor Manuel De Anda-Uribe, Monterrey (MX); Ignacio Luis Ayala, San Pedro Garza Garcia (MX); Nikhll S. Nagaswami, Newark, DE (US); Leopoldo Cardenas-Siller, Monterrey (MX); Manuel Gerardo Balderas-Ayala, Monterrey (MX); Fernando Serna-Garza, Monterrey (MX); Gerardo Gutierrez-Ortega, San Pedro Garza Garcia (MX)

(73) Assignee: Viasa Incorporated, S.A. DE C.V., Monterrey (MX)

( * ) Notice: Subject to any disclaimer, the term of this patent is extended or adjusted under 35 U.S.C. 154(b) by 521 days.

(21) Appl. No.: 10/349,742

(22) Filed: Jan. 22, 2003

(65) Prior Publication Data

US 2004/0140106 A1 Jul. 22, 2004

(51) Int. Cl.
*A62C 27/00* (2006.01)

(52) U.S. Cl. ..... 169/24; 169/25; 239/279

(58) Field of Classification Search ..... 169/11, 169/15, 24, 25, 46, 66, 67; 239/279, 280, 239/280.5, 531–532; 111/7.1–7.4; 248/88, 248/87, 156, 159; 362/287
See application file for complete search history.

(56) References Cited

U.S. PATENT DOCUMENTS

| | | | | |
|---|---|---|---|---|
| 1,293,500 A | | 2/1919 | Mason | |
| 1,775,846 A | | 9/1930 | Blaw | |
| 2,079,438 A | | 5/1937 | Ellis | |
| 3,220,482 A | | 11/1965 | Eveleth | |
| 3,588,893 A | | 6/1971 | McCloskey | |
| 3,741,309 A | | 6/1973 | McCulloch | |
| 3,876,010 A | | 4/1975 | Blomquist et al. | |
| 4,007,793 A | * | 2/1977 | Hux et al. | 169/25 |
| 4,037,664 A | | 7/1977 | Gibson | |
| 4,148,361 A | | 4/1979 | Christensen | |
| 4,246,906 A | | 1/1981 | Winberg et al. | |
| 4,410,045 A | * | 10/1983 | Whitman | 169/24 |
| 4,433,733 A | | 2/1984 | Cunningham | |
| 4,436,487 A | | 3/1984 | Purvis et al. | |
| 4,729,434 A | | 3/1988 | Rohrbach | |
| 4,781,252 A | | 11/1988 | Wilburn et al. | |
| 4,839,681 A | | 6/1989 | Hamano | |
| 4,875,526 A | * | 10/1989 | Latino et al. | 169/24 |

(Continued)

FOREIGN PATENT DOCUMENTS

MX 531 U 11/1994

*Primary Examiner*—David A. Scherbel
*Assistant Examiner*—Thach H. Bui
(74) *Attorney, Agent, or Firm*—Baker & McKenzie, LLP

(57) ABSTRACT

An fire-fighting system for arresting a fire in a flammable or combustible liquid storage vessel comprising a portable discharging apparatus and a portable installation apparatus. The portable discharging apparatus receives a fire-fighting agent from a supply hose and applies the fire-fighting agent to arrest a fire in a storage vessel. The portable discharging apparatus can be attached to a distal end of the portable installation apparatus so that the portable discharging apparatus can be mounted on a storage vessel. Furthermore, a plurality of portable discharging apparatuses can be mounted on a single storage vessel, using the same portable installation apparatus, to provide a large amount or a variety of fire-fighting agents or to provide fire-fighting agents at a specific location on the storage vessel. The portable installation apparatus can be extended to a variety of lengths so that it can mount a portable discharging apparatus on a variety differently sized storage vessels.

47 Claims, 19 Drawing Sheets

U.S. PATENT DOCUMENTS 4,893,681 A 1/1990 Flandre
5,174,383 A 12/1992 Haugen et al.
5,240,078 A 8/1993 Worthington
5,301,756 A * 4/1994 Relyea et al. ..... 169/24
5,398,765 A 3/1995 Worthington
5,566,766 A 10/1996 Williams
5,573,068 A 11/1996 Sharma et al.
5,829,533 A 11/1998 Williams
5,836,398 A * 11/1998 White ..... 169/24
5,913,366 A 6/1999 Williams et al.
6,019,484 A * 2/2000 Seyler ..... 362/287

* cited by examiner

METHOD AND APPARATUS FOR EXTINGUISHING FIRES IN STORAGE VESSELS CONTAINING FLAMMABLE OR COMBUSTIBLE LIQUIDS

BACKGROUND

Traditional fire-fighting methods for fighting fires in storage vessels containing flammable liquids may require the application of a plurality of fire-fighting agents issued from one or more discharging apparatuses. These methods include:

a) Long range fire-fighting methods including fixed, semi-portable or portable systems that discharge fire-fighting agents from a position located afar from the storage vessel. These include fixed monitors, semi-portable monitors, fixed cannons, vehicle mounted cannons, hand held nozzles, etc.

b) Fixed systems permanently installed on the storage vessel. These include fixed foam chambers mounted on the roof of the storage vessel, circumferential discharge system or seal area protection systems on floating roof tanks, sub-surface injection systems, etc.

c) Portable systems that are used for mounting discharging apparatuses on the storage vessel.

Each of these traditional fire-fighting methods possess certain limitations that can include one or more of the following:

their effectiveness in the application of the fire-fighting agent;

the operating system requirements;

the costs associated with the acquisition of the fire-fighting equipment and necessary peripheral equipment;

the costs associated with the operation of the equipment, namely the volume of fire-fighting agent consumed;

the time required to extinguish the fire and resume normal operations; and the associated damages related to property, plant, equipment and lost production.

The limitations of long range fire-fighting methods discussed in a) above, include the following:

a significantly higher minimum system pressure is required for the fire-fighting agent to reach the surface of the flammable liquid in the storage vessel;

the costs are significantly higher in acquiring, maintaining and operating fire-fighting equipment operating at these higher pressures;

the radial component in the stream velocity is allowed more time to develop, hence dispersing the fluid flow, thereby increasing the cross-sectional impact area of the fire-fighting agent, thus decreasing the concentration of the fire-fighting agent, and finally reducing the effectiveness of the fire-fighting agent in arresting the fire;

the atmospheric winds surrounding the vessel and the convective gases arising from the fire also contribute significantly to the dispersion of the fire-fighting agent thereby reducing the effectiveness of the fire-fighting agent in arresting the fire; and the longer trajectory of the stream of the fire-fighting agent from the discharge point to the target area increases the amount of air dragged into the stream of the fire-fighting agent and onto the surface of the flammable liquid thereby increasing the oxygenation of the fire.

The Industry has generally sought to address the above performance limitations in arresting the fire by increasing the rate of application of fire-fighting agents from 3,000 GPM to 5,000 GPM to 10,000 GPM, using a "surround and drown" approach. This method significantly increases the amounts of fire-fighting agents consumed and thereby the costs associated with extinguishing the fire.

The limitations of fixed systems that are permanently installed on storage vessels, discussed in b) above, include the following:

the foam chambers permanently installed on the roof of storage vessels, traditionally the first line of defense in the event of a fire, are highly vulnerable and are frequently rendered entirely inoperable in the initial phase of the conflagration when violent explosions may occur; and the Sub-surface injection systems can be rendered inoperable due to the effects of an explosion and more often due to clogging of the system.

The limitations of portable systems that are used for mounting discharging apparatuses on the storage vessel, discussed in c) above, can include one or more of the following:

they operate only with pre-mixtures of foam concentrate and water;

they do not include apparatus for mixing the fire-fighting agents with a conveying media;

they are designed to discharge only one type of fire-fighting agent, for example foam;

the foam discharge device is not detachable from the installation apparatus and therefore the installation of each discharge device requires its own installation apparatus; and they do not include an apparatus for the transportation of the entire system.

In view of the limitations of the traditional fire-fighting methods discussed above, the applicants have developed a portable system for extinguishing fires in storage vessels containing flammable liquids that seeks to complement the positive performance aspects of these methods while addressing many of their core performance limitations.

There is therefore a need in the art for low-cost fire-fighting equipment that can be used to extinguish fires on or within a flammable substance in storage vessel. There is also a need for a system that is not permanently installed on the storage vessel so that the fire-fighting equipment is not damaged or destroyed by the explosions or conflagrations often associated with the initial stage of a fire. There is also a need for a portable fire-fighting apparatus that does not attempt to spray fire-fighting agents from a remote position. In addition, there is a need for a fire-fighting apparatus that does not utilize costly high-pressure equipment.

BRIEF SUMMARY

This disclosure relates to the mounting or placement of one or more portable discharging apparatuses on the top perimeter of a storage vessel that contains a flammable substance. The portable discharging apparatus is adapted to issue a fire-fighting agent, at relatively low pressures, at the top of the burning storage vessel so as to extinguish a fire. The fire-fighting agent may be applied to the surface of the burning liquid either indirectly, by issuing the fire-fighting agent against the inner walls of the storage vessel, or directly into the burning surface. The portable discharging apparatus may be installed on the storage vessel with a portable installation apparatus that can repeatedly install a plurality of portable discharging apparatuses on a burning storage vessel. The portable discharging apparatus is suitable for use with a wide variety of storage vessels including, without limitation, cylindrical storage tanks, spherical storage tanks, storage basins, railcars, tractor-trailers, ships, and barges. The portable discharging apparatus discharges fire-fighting agents, such as fire-fighting foams, onto the surface of a storage vessel. The portable discharging apparatus may also discharge the fire-fighting agents directly onto a surface of the burning substance itself. The fire-fighting agent may comprise any number of well known fire-fighting mixtures, such as foam concentrates and water, foam concentrates and air, powders in a conveying media, chemical agents, colloids, gels or other agents. One or more different types of fire-fighting agents can be applied to a fire either simultaneously, or one at a time.

The disclosed system comprises one or more portable discharging apparatuses that can be removably mounted on a flammable liquid storage vessel for discharging at least one fire-fighting agent. The system may further comprise one or more portable installation apparatuses for installing said one or more portable discharging apparatuses on said storage vessel. The system may further comprise one or more transportation apparatuses for carrying at least one portable fire-fighting apparatus and at least one portable installation apparatus. The system may further comprise one or more fire-fighting agent conditioning apparatuses for preparing the formulated proportions of the fire-fighting agents and the conveying media.

Only one portable installation apparatus is required to be transported to the fire site to removably mount a plurality of portable discharging apparatuses onto a storage vessel wall. The disclosed system further provides a method for extinguishing fires by removably attaching one or more portable discharging apparatus to a storage vessel for discharging a fire-fighting agent; providing a mobile installation apparatus for removably attaching one or more said portable discharging apparatus on said storage vessel; and providing a transportation apparatus for carrying at least one portable discharging apparatus and one mobile installation apparatus.

The portable discharging apparatus, the portable installation apparatus and other accessories for issuing fire-fighting agents may be readily transported to the site of a fire. The portable installation apparatus is deployed near the burning vessel and is used to place one or more of the portable discharging apparatuses on the top perimeter of a storage vessel wall after the conflagration has begun and the possible violent explosive phase has passed. Once the portable discharging apparatus is removably mounted or placed on the wall, the portable installation apparatus may be removed without hindering the continued operation of the portable discharging apparatus. After this, the portable installation apparatus may be used to mount other portable discharging apparatuses to the vessel or other vessels. Only one source of pressurized fluid (i.e. conveying media) need by used with multiple portable discharging apparatuses.

A portable discharging apparatus can comprise a hollow circular tube, referred to as a discharge duct. A discharge attachment may be attached to the discharge duct to aim the flow of the fire-fighting agent in a specific direction. The discharge attachment may be connected to the discharge duct at a mating junction to aim the flow of the fire-fighting agent in other directions. A flow collimator is attached to the other end of the discharge duct and provides a supply of fire-fighting agents to the discharge duct. The flow collimator may also include a jet stream enhancer plate, which increases the flow velocity of the fire-fighting agent, thereby enhancing the mixing of the fire-fighting agent with inflowing air to efficiently aerate the fire-fighting agent. Specifically, in the embodiment of a foam concentrate mixed with water as the fire-fighting agent, the collision of the foam concentrate mixture with the in flowing air generates a higher quality of fire-fighting foam.

The portable installation apparatus can also comprise a plurality of extendible sections so that the length of the apparatus may be adjusted to correspond to the height of a particular storage vessel. Specifically, by extending the length of the telescopic mast of the portable installation apparatus, the portable discharging apparatus (or apparatuses) may be mounted or placed on storage vessels of a variety of heights. The portable installation apparatus may also have a foldable compact configuration so that it can be readily transported as a pre-assembled structure that may be quickly unfolded at the location of a fire for rapid deployment and operation. Another advantage of the disclosed system is its lower acquisition and operational costs.

These and other advantages of the system for extinguishing fires will become apparent to those of ordinary skill in the art from the following detailed description, which refers to the accompanying drawings.

DETAILED DESCRIPTION

Figure 1A:
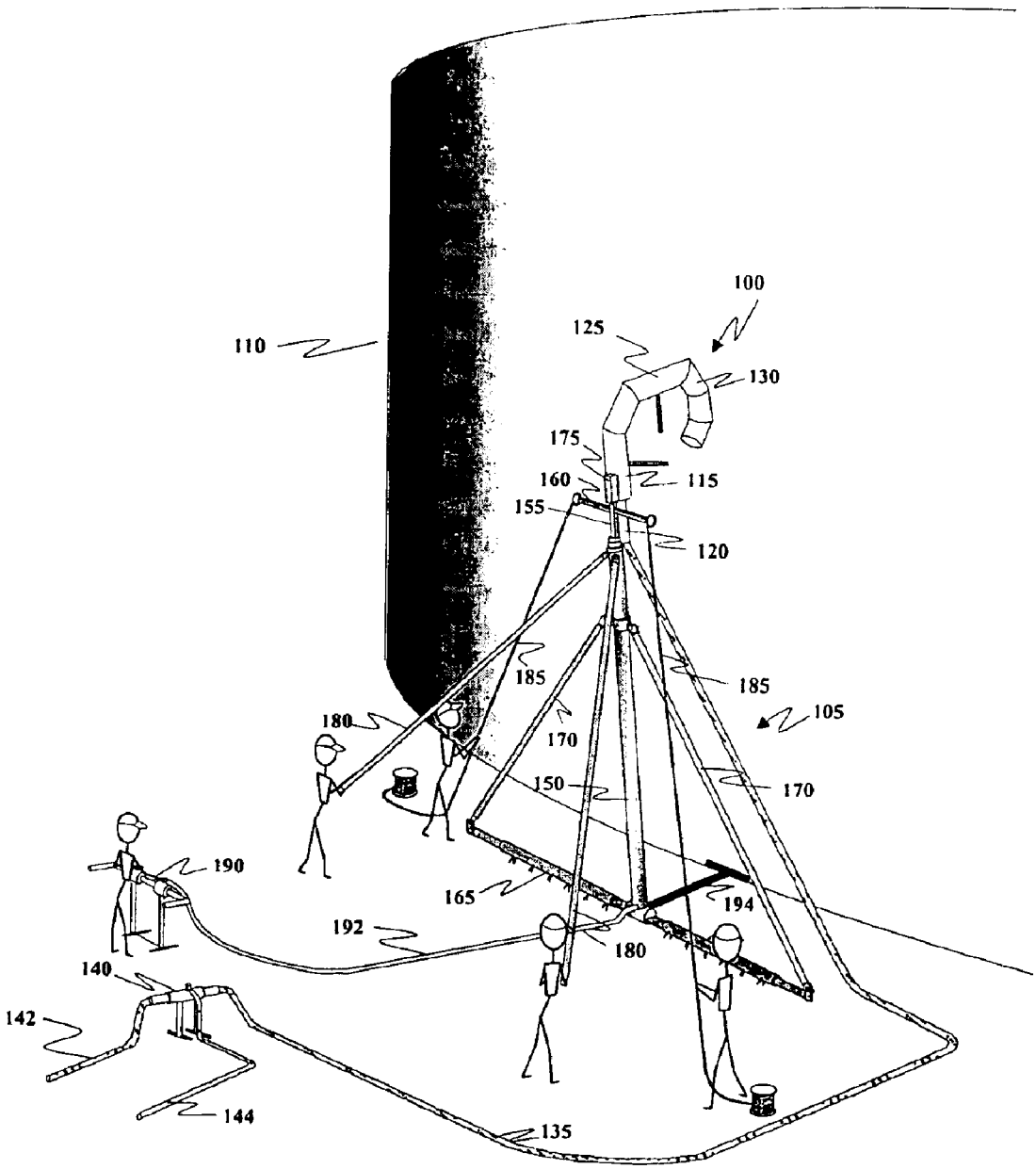
FIG. 1A is a perspective view of one aspect of the invention in which a portable discharging apparatus is shown attached to the portable installation apparatus prior to the extension of the portable installation apparatus.

Two components of a fire-fighting system according to one aspect of the invention are depicted in FIG. 1A: a portable discharging apparatus 100 and a portable installation apparatus 105. The portable discharging apparatus 100 may be removably coupled to the portable installation apparatus 105 so that one or more of the portable discharging apparatuses 100 can be mounted or placed on the top of a storage vessel 110. After the portable discharging apparatus 100 is mounted or placed on a storage vessel 110, fire-fighting agents are introduced into one end of the portable discharging apparatus and issued at the discharge end to extinguish a fire in the storage vessel.

The portable discharging apparatus 100 is comprised of several components, some of which are depicted in FIG. 1A. The depicted components include a receptacle duct 115, a flow collimator 120, a discharge duct 125, and an arc-shaped flow discharge attachment 130. A supply hose 135 is attached to the flow collimator 120 to provide a supply of fire-fighting agents to the portable discharging apparatus 100. Also depicted in FIG. 1A is a mixing apparatus 140, adapted to mix the fire-fighting agent concentrate with a supply of a conveying media in the required proportions before it is fed into the supply hose 135. Accordingly, a conveyance media supply line 142, and a fire-fighting agent supply line 144, are connected to the mixing apparatus 140.

The portable installation apparatus 105 is also comprised of several components, some of which are also depicted in FIG. 1A. These components include a telescopic mast 150, a base tube 165 and a pair of lateral support struts 170. The telescopic mast 150, the base tube 165 and the lateral support struts 170 are arranged in a generally triangular shape to provide a simple and stable support for erecting the portable installation apparatus 105. A support rod 155 with a horizontal control rod 160 is affixed to the top of the telescopic mast 150. The support rod 155 and the support rod receptacle 175 join the portable discharging apparatus 100 to the portable installation apparatus 105. Specifically, the portable discharging apparatus 100 may be removably coupled to the portable installation apparatus by inserting the support rod 155 into the support rod receptacle 175, which is permanently affixed to the receptacle duct 115. While the disclosed embodiment depicts a support rod 155 and a support rod receptacle 175 as the means by which the portable discharging apparatus 100 is attached to the portable installation apparatus 105, other suitable coupling devices will be apparent to one of ordinary skills, such as a hook and eye bolt connection, or other such means. Some of the other components of the portable installation apparatus 105 are stabilizing rods 180, which may be coupled to the telescopic mast 150 to provide stability and control during the installation of the portable discharging apparatus 100. Also depicted are tether lines 185, which are connected to the ends of the horizontal control rod 160 to provide further stability and control for orienting the portable discharging apparatus during the installation process.

Another aspect of the portable fire-fighting apparatus depicted in FIG. 1A is an installation control system 190 that controls the flow of hydraulic fluid to the portable installation apparatus 105. The installation control system 190 provides bi-directional hydraulic fluid flow through the hydraulic line 192 to the telescopic mast 150. As this hydraulic fluid is supplied, the telescopic mast 150 will be extended, thereby lifting the portable discharging apparatus 100 until it reaches the height of the storage vessel 110. Similarly, by removing hydraulic fluid from the telescopic mast 150, it can be retracted. According to one embodiment of the invention, hydraulic fluid is injected into or released from the hollow cavity of the telescopic mast 150 to either expand or contract the telescopic mast 150. The hydraulic fluid flows into and out of the cylindrical cavity though the hydraulic line 192 with a quick disconnect coupler that functions as a check valve at an orifice at the base of telescopic mast 150. The check valve operation is deactivated whenever the hydraulic line 192 is inserted into the quick disconnect coupler and activated when the hydraulic line 192 is removed from the quick disconnect coupler. Yet another aspect of the portable fire-fighting apparatus depicted in FIG. 1A is a spacer member 194 that may be placed between the base tube 165 of the portable installation apparatus 105 and a wall of the storage vessel 110. The spacer member 194 is used to maintain a distance between the portable installation apparatus 105 and the wall of the storage vessel 110 during the installation of a portable discharging apparatus 100, thereby increasing the forward stability of the portable installation apparatus 105 as it raises or lowers the portable discharging apparatus 100.

Figure 1B:
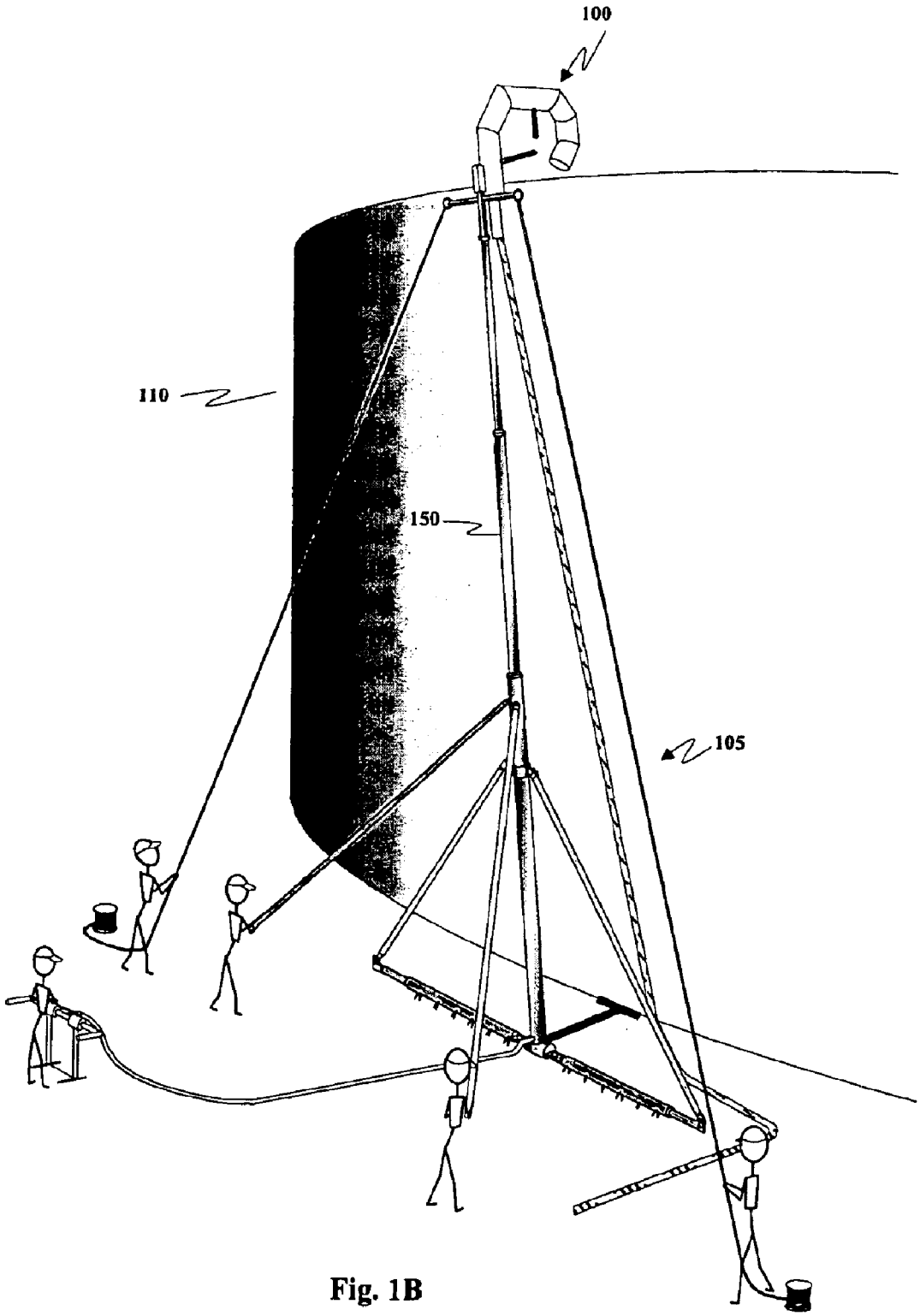
FIG. 1B is a perspective view of another aspect of the invention in which a portable discharging apparatus is shown attached to the portable installation apparatus after the portable installation apparatus has been extended and prior to the portable discharging apparatus being mounted or placed on the storage vessel.

A fully extended portable installation apparatus 105 is depicted in FIG. 1B wherein the telescoping sections of the telescopic mast 150 are fully extended. As described above, the extension and retraction of the telescopic mast is controlled by the installation control system 190. According to the disclosed embodiment, the telescopic mast 150 of the portable installation apparatus 105 is comprised of a plurality of axially concentric sliding hollow cylinders. The inner hollow cylinders slide out of the top-end of the outer cylinder to extend the telescopic mast along the common axis to the length required to reach the upper perimeter rim of the storage vessel 110. Wide varieties of means are known in the art and are available to extend or contract the inner cylinders of the telescopic mast 150.

After the portable discharging apparatus 100 is lifted over the edge of the storage vessel 110 and any fixed obstacles such as perimeter rails or cat walks, the telescopic mast 150 is lowered so as to locate the portable discharging apparatus 100 on the edge of the storage vessel 110.

After the portable discharging apparatus 100 is mounted or placed on the storage vessel 110, the portable installation apparatus 105 may be disengaged from the portable discharging apparatus 100 thereby leaving the portable discharging apparatus 100 mounted on the storage vessel 110. After the portable installation apparatus 105 has been used to place a portable discharging apparatus 100 on the storage vessel 110, it may be moved to different locations to successively mount a plurality of portable discharging apparatuses 100.

Figure 1C:
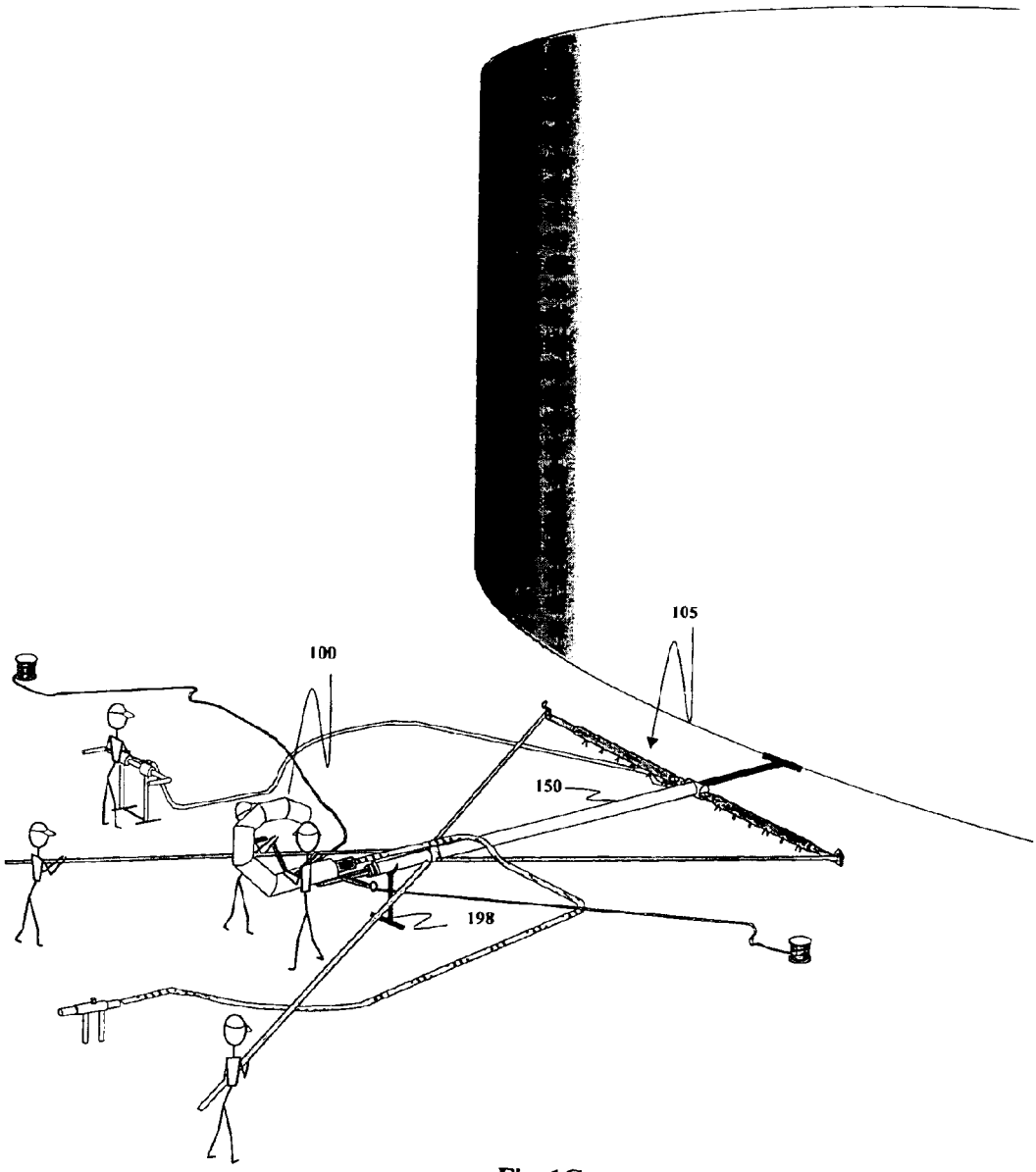
FIG. 1C is a perspective view of another aspect of the invention in which the portable discharging apparatus is shown being attached to the portable installation apparatus.

FIG. 1C depicts the assembly of the portable installation apparatus 105 and the portable discharging apparatus 100 according to one aspect of the invention. The portable installation apparatus 105 is shown with the telescopic mast 150 elevated at the distal end and supported using the support pedestal 198 for the purpose of facilitating the assembly process.

Figure 1D:
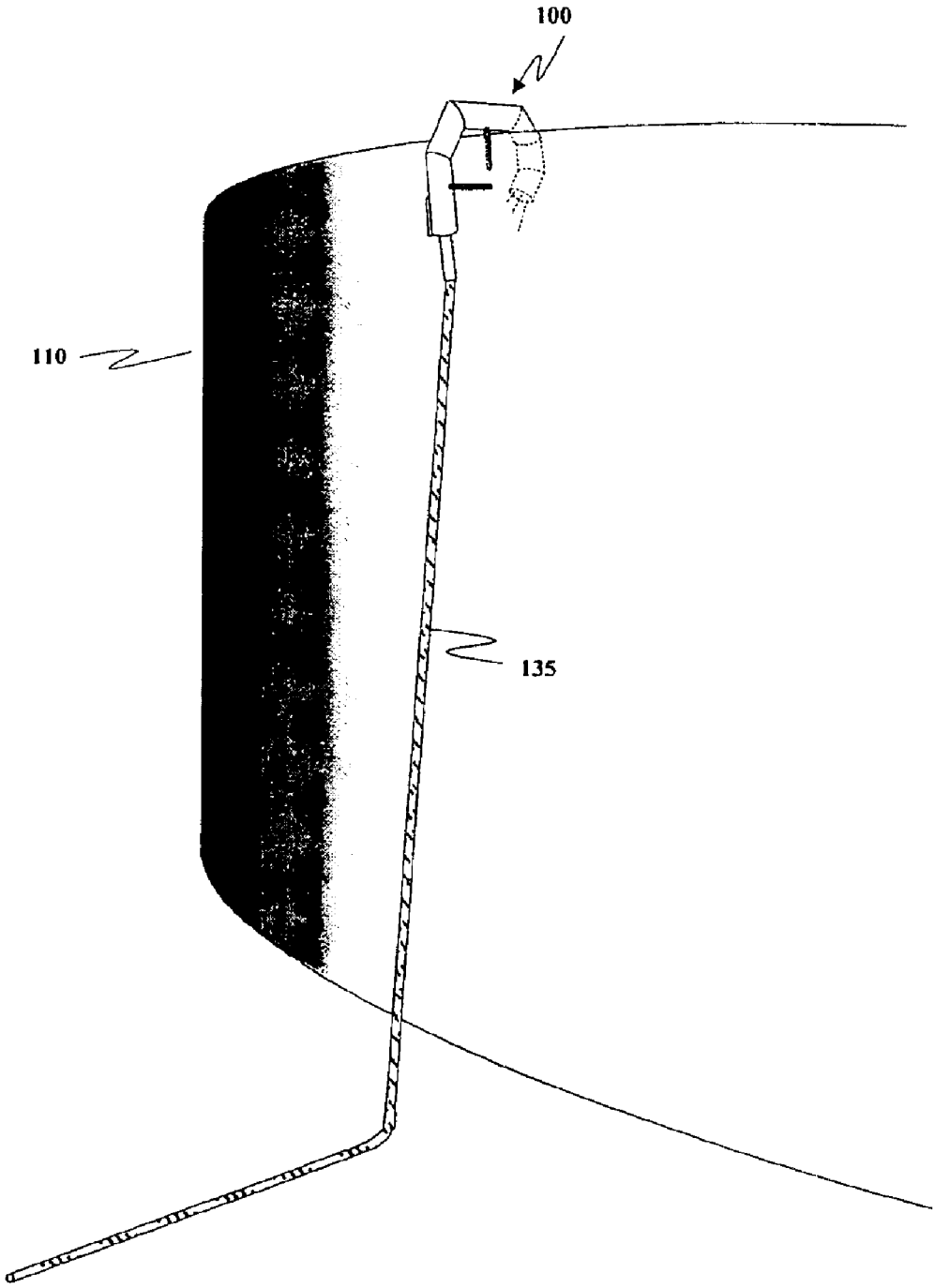
FIG. 1D is a perspective view of another aspect of the invention in which a portable discharging apparatus is mounted or placed on the top of a storage vessel and the portable installation apparatus has been removed.

A portable discharging apparatus 100 that has been mounted or placed on a storage vessel 110 is depicted in FIG. 1D. A supply hose 135 remains connected to the portable discharging apparatus 100 so that the fire-fighting agent can be applied continuously to the storage vessel 110. Thus, after the portable discharging apparatus 100 is mounted or placed on the top of the storage vessel 110, it can function independently to provide fire-fighting agents without the portable installation apparatus 105.

Figure 1E:
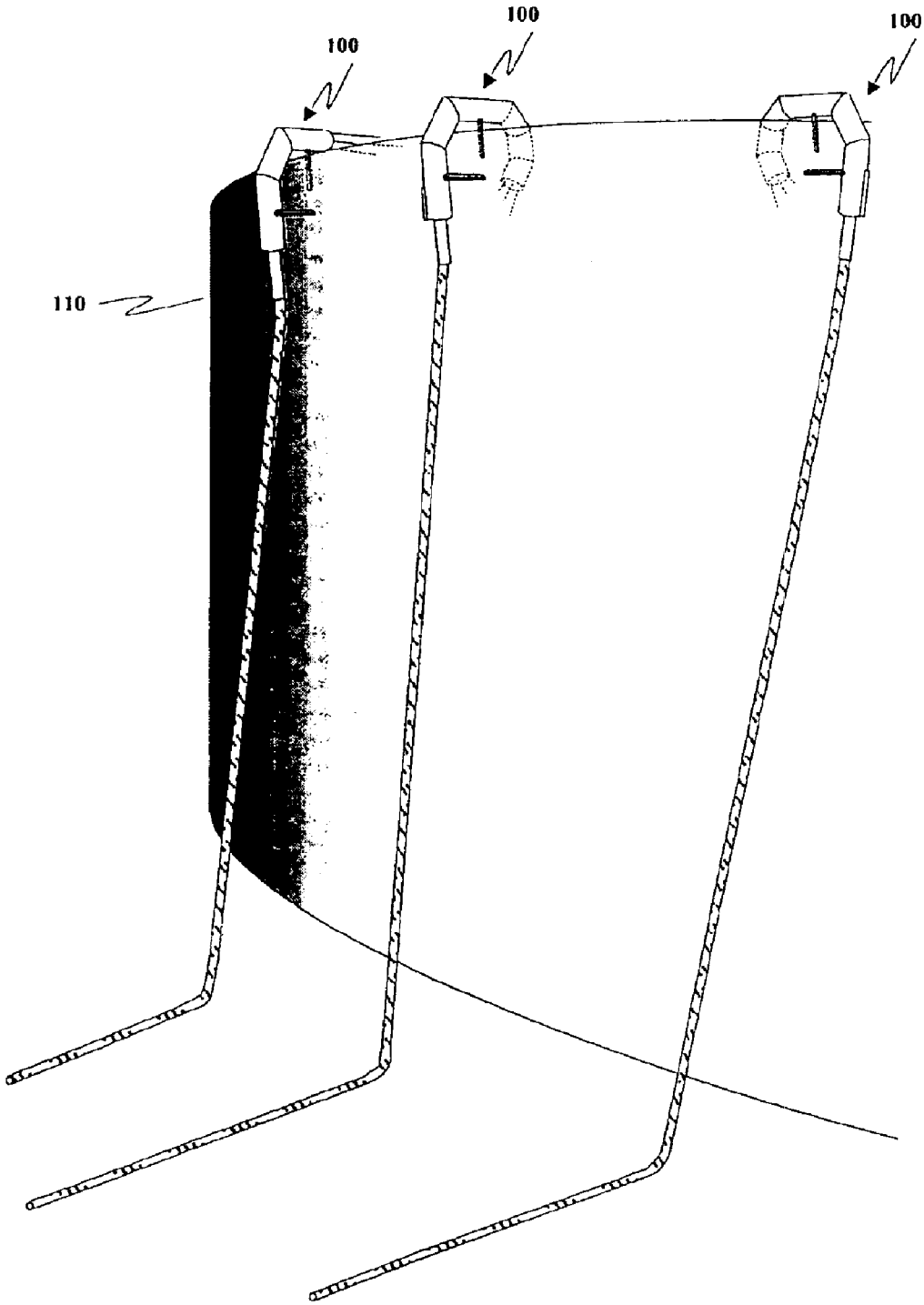
FIG. 1E is a perspective view of another aspect of the invention in which a plurality of portable discharging apparatuses are mounted or placed on the top of a storage vessel and the portable installation apparatus has been removed.

More than one portable discharging apparatus 100 may be mounted or placed on a storage vessel 110. This embodiment is depicted in FIG. 1E where three separate portable discharging apparatuses 100 are mounted or placed on the storage vessel 110. This embodiment may be suitable for large surface-area vessels or for large fires, which may require the application of larger amounts of fire-fighting agents.

Figure 2A:
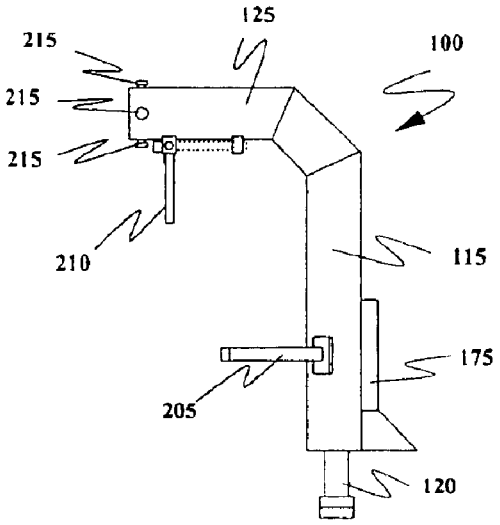
FIG. 2A is a side view of a portable discharging apparatus according to one aspect of the invention.

Various embodiments of the portable discharging apparatus are depicted in FIGS. 2A through 2H. FIG. 2A depicts a side view of a portable discharging apparatus 100 in further detail. As described previously, the portable discharging apparatus 100 may be comprised of a flow collimator 120, a receptacle duct 115, a discharge duct 125 and a support rod receptacle 175. Also depicted in FIG. 2A are a first rigid device 205 and a second rigid device 210. These rigid devices 205 and 210 work in unison to provide the required orientation for the portable discharging apparatus 100 and for maintaining the positional stability of the portable discharging apparatus 100 on the upper edge of the storage vessel 110 wall. The portable discharging apparatus 100 can be stabilized in this position using various other coupling mechanisms, such as spring loaded stabilizers, clamps, magnets and other means known in the art. This embodiment of the portable discharging apparatus 100 is suited for orienting the flow of the fire-fighting agent directly onto the surface of the burning liquid in the storage vessel 110. The portable discharging apparatus 100 is also equipped with connection means, connecting bolts 215 in this embodiment, that allow the connection of alternate attachments to the portable discharging apparatus 100.

Figure 2B:
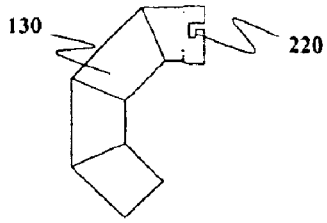
FIG. 2B is a side view of an arc-shaped flow discharge attachment according to another aspect of the invention.

Another component that may be used with the portable discharging apparatus 100 is an arc-shaped flow discharge attachment 130, a representative embodiment of which is depicted in FIG. 2B. The discharge attachment 130 is used, to direct the flow of the fire-fighting agent being discharged from the portable discharging apparatus 100 in a specific direction to extinguish a fire. The arc-shaped flow discharge attachment 130 of FIG. 2B is designed to be connected to the end of the discharge duct 125 by joining the connecting bolts 215 with the eye and bolt 220 of the arc-shaped flow discharge attachment 130. A wide variety of other means for attaching the arc-shaped flow discharge attachment 130 to the discharging duct 125 are known in the art and may be suitable for use with this invention, such as spring loaded tensors, buckles or other means.

Figure 2C:
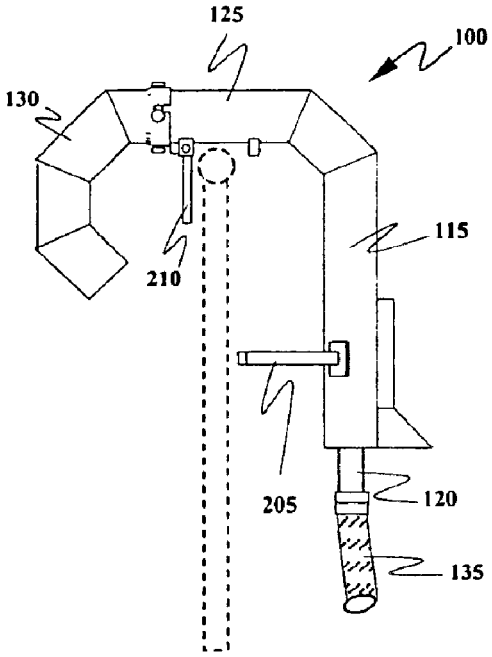
FIG. 2C is a side view of a portable discharging apparatus and arc-shaped flow discharge attachment that is mounted or placed on an upper wall of a storage vessel according to one aspect of the invention.
Figure 2D:
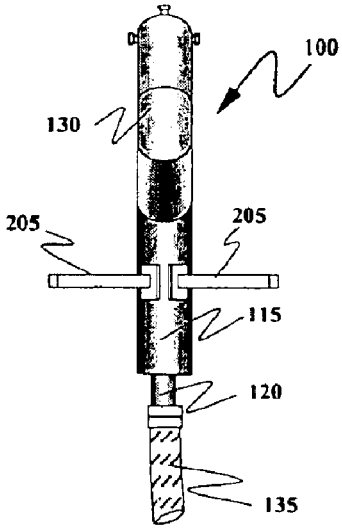
FIG. 2D is a front view of a portable discharging apparatus and arc-shaped flow discharge attachment according to one aspect of the invention.

A portable discharging apparatus 100 that includes an arc-shaped flow discharge attachment 130 is depicted in FIG. 2C wherein the portable discharging apparatus 100 is mounted onto the upper edge of the wall of a storage vessel 110. As the portable discharging apparatus 100 is mounted or placed on the storage vessel 110, the first rigid device 205 maintains a space between the portable discharging apparatus 100 and the wall of the storage vessel 110. In addition, the second rigid device 210 secures the apparatus 100 onto the upper edge of the storage vessel wall 110. A supply hose 135 is connected to the flow collimator 120 to supply a mixture of fire-fighting agents to the receptacle duct 115. In FIG. 2C, the embodiment of the portable discharging apparatus 100 with the arc-shaped flow discharge attachment 130 is suited for orienting the flow of the fire-fighting agent against the inside wall of the storage vessel 110. Other embodiments, however, may be utilized to direct the fire-fighting agent in different directions. FIG. 2D is a front view of the portable discharging apparatus 100 and an arc-shaped flow discharge attachment 130.

Figure 2E:
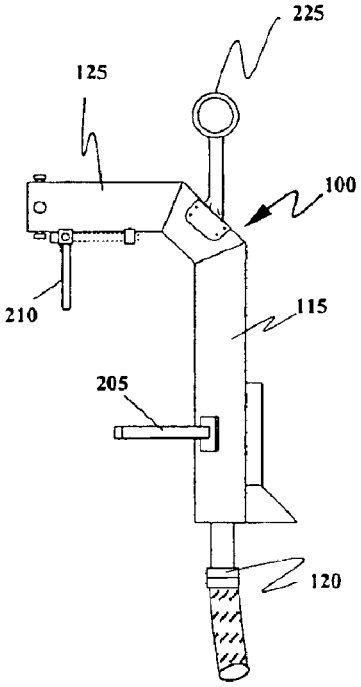
FIG. 2E is a side view of a portable discharging apparatus according to another aspect of the invention for placing or mounting using a mounting loop.
Figure 2F:
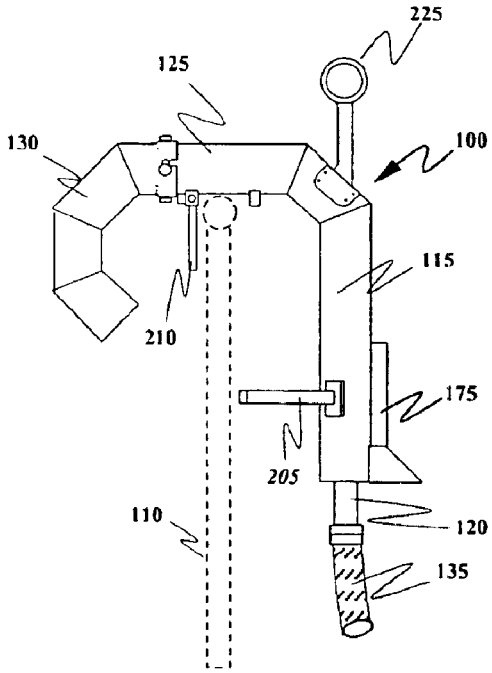
FIG. 2F is a side view of a portable discharging apparatus and arc-shaped flow discharge attachment that is mounted or placed on an upper wall of a storage vessel using a mounting loop.

In FIG. 2E, a side view of a portable discharging apparatus 100 is depicted. This embodiment incorporates a mounting loop 225 which is attached to the receptacle duct 115. This mounting loop 225 provides another means by which the portable discharging apparatus 100 may be mounted or placed on a storage vessel 110. Specifically, the portable discharging apparatus 100 may be raised or lowered by attaching the mounting loop 225 to a hook that is connected to a crane or other such conveyances. FIG. 2F depicts an alternative embodiment for the portable discharging apparatus 100 with an arc-shaped flow discharge attachment 130, and the mounting loop 225 mounted or placed on the upper edge of the wall of a storage vessel 110.

Figure 2G:
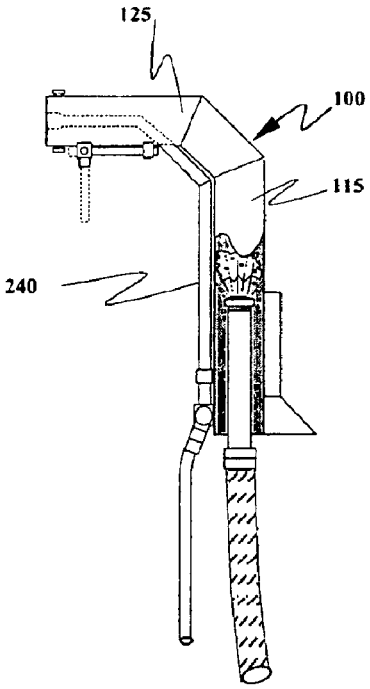
FIG. 2G is a side view of a portable discharging apparatus according to another aspect of the invention showing a passage duct.

In FIG. 2G, a side view of a particular embodiment of the portable discharging apparatus 100 is depicted wherein a passage duct 240 is externally attached to the receptacle duct 115, passes into the discharge duct 125 and terminates concentrically at the output end of the discharge duct 125. The passage duct 240 is used to deliver an additional fire-fighting agent, such as powders, colloids, gels, etc. within the discharge stream of the fire-fighting agent being delivered through the discharge duct 125. This embodiment permits the use of more than one fire-fighting agent simultaneously and orients the flow of the fire-fighting agents directly onto the surface of the burning liquid in the storage vessel 110.

Figure 2H:
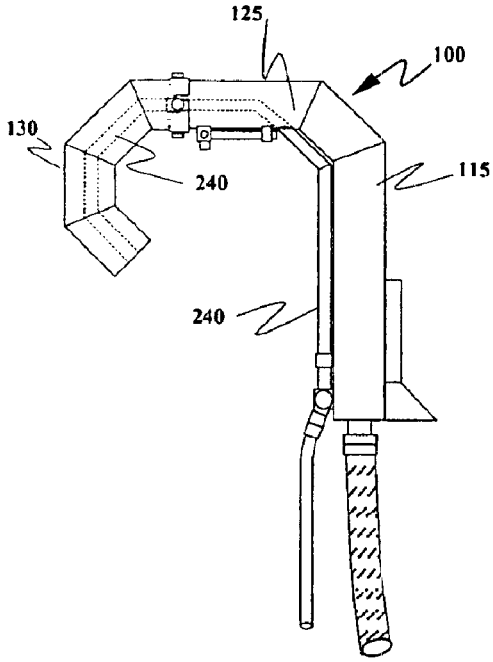
FIG. 2H is a side view of a portable discharging apparatus, arc shaped flow discharge attachment and passage duct, according to another aspect of the invention.

In FIG. 2H, a side view of a particular embodiment of the portable discharging apparatus 100 and an arc-shaped flow discharge attachment 130 is depicted wherein the passage duct 240 extends concentrically through the interior of the arc-shaped flow discharge attachment 130. This embodiment permits the use of more than one fire-fighting agent simultaneously and orients the flow of the fire-fighting agents directly onto the inner wall of the storage vessel 110.

In other embodiments, the passage duct 240 may be attached externally on the portable discharging apparatus 100 and the arc-shaped flow discharge attachment 130. More than one additional passage duct 240 may be attached to the portable discharging apparatus 100 for conveying and issuing a plurality of fire-fighting agents.

Figure 3A:
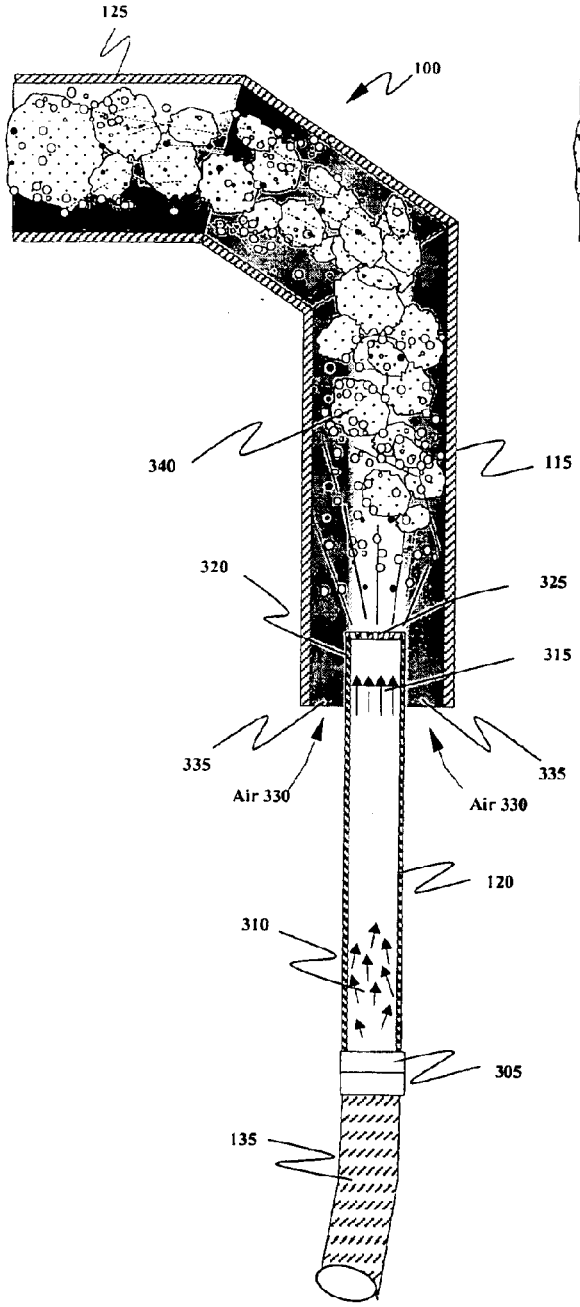
FIG. 3A is a longitudinal, cross-sectional view of an alternative embodiment of the portable discharging apparatus including a receptacle duct; a jet-stream enhancer plate and a flow collimator positioned for higher system pressure operations.

FIG. 3A depicts a longitudinal cross-sectional view of an alternative embodiment of the portable discharging apparatus 100, illustrating the positioning of the flow collimator 120 to the receptacle duct 115, as well as the mixing operations provided by these elements. After the fire-fighting agents pass through the flow collimator 120, they are aerated and passed from the receptacle duct 115 to the discharge duct 125. A mixture of foam concentrate is provided into a first end 305 of the flow collimator 120 by a supply hose 135. The conveyance of the mixture through the flexible supply hose 135 imparts a high degree of turbulence or non-uniform velocity in the mixture flow, shown by arrows 310, arriving at the first end 305. A higher level of turbulence in the flow results in a greater pressure loss along the length of the supply hose 135. The flow collimator 120 is used to pre-condition the mixture flow to obtain a higher degree of uniformity in the flow velocity of the mixture flow, as depicted by arrows 315, prior to passing through the jet-stream enhancer plate 325 with an end result of a better, more efficient and cost effective foam generation process. The flow collimator 120 may be comprised of a cylindrical tube of sufficient length to collimate the mixture. Upon reaching a second end 320 of the flow collimator 120, the foam concentrate mixture passes through a jet-stream enhancer plate 325. The jet-stream enhancer plate 325 increases the velocity of the flow and directs the foam concentrate mixture against the interior surface of the receptacle duct 115 thereby increasing the impact force between the foam concentrate mixture and the air 330, thus improving the foaming process. Furthermore, the flow of the foam concentrate mixture from the flow-collimator 120 into the receptacle duct 115 draws a supply of air 330 into the air input port 335, which is located at a first end of the receptacle duct 115. As the foaming agent is distributed throughout the interior of the receptacle duct 115, it is mixed with the air 330 that is drawn in from the air input port 335 so as to generate a foam 340 that will be directed towards a second end of the receptacle duct 115. The embodiment depicted in FIG. 3A utilized a flow collimator 120 and a jet-stream enhancer plate 325 to generate the foam 340, however, one of ordinary skill in the art will realize that other arrangements may be utilized to generate a foam.

Figure 3B:
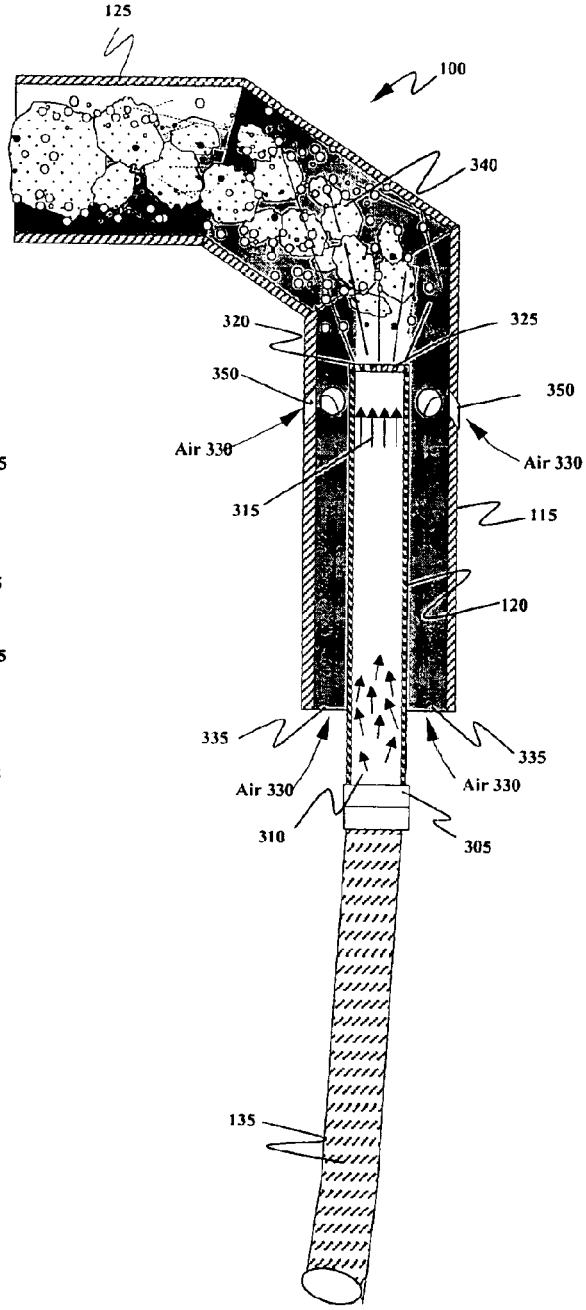
FIG. 3B is a longitudinal, cross-sectional view of an alternative embodiment of the portable discharging apparatus including a receptacle duct; a jet-stream enhancer plate and a flow collimator positioned for lower system pressure operations.

FIG. 3B depicts an alternative embodiment of the invention wherein the jet-stream enhancer plate 325, together with the collimator tube 120, are positioned at such a height, so as to reduce the vertical column of foam between the jet-stream enhancer plate 325 and the top of the receptacle duct 115, thus allowing a lower system pressure to overcome the back pressure of the foam 340 and thus obtain a higher fire-fighting agent flow at a lower pressure.

This alternative embodiment incorporates many of the same components as the embodiment depicted in FIG. 3A. The embodiment depicted in FIG. 3B, however, incorporates certain differences. Specifically, a much longer portion of the flow collimator 120 is placed within the receptacle duct 115. In addition, air vents 350 are incorporated into the sidewall of the receptacle duct 115 in order to facilitate the mixing of the fire-fighting agents with the air 330.

Figure 4:
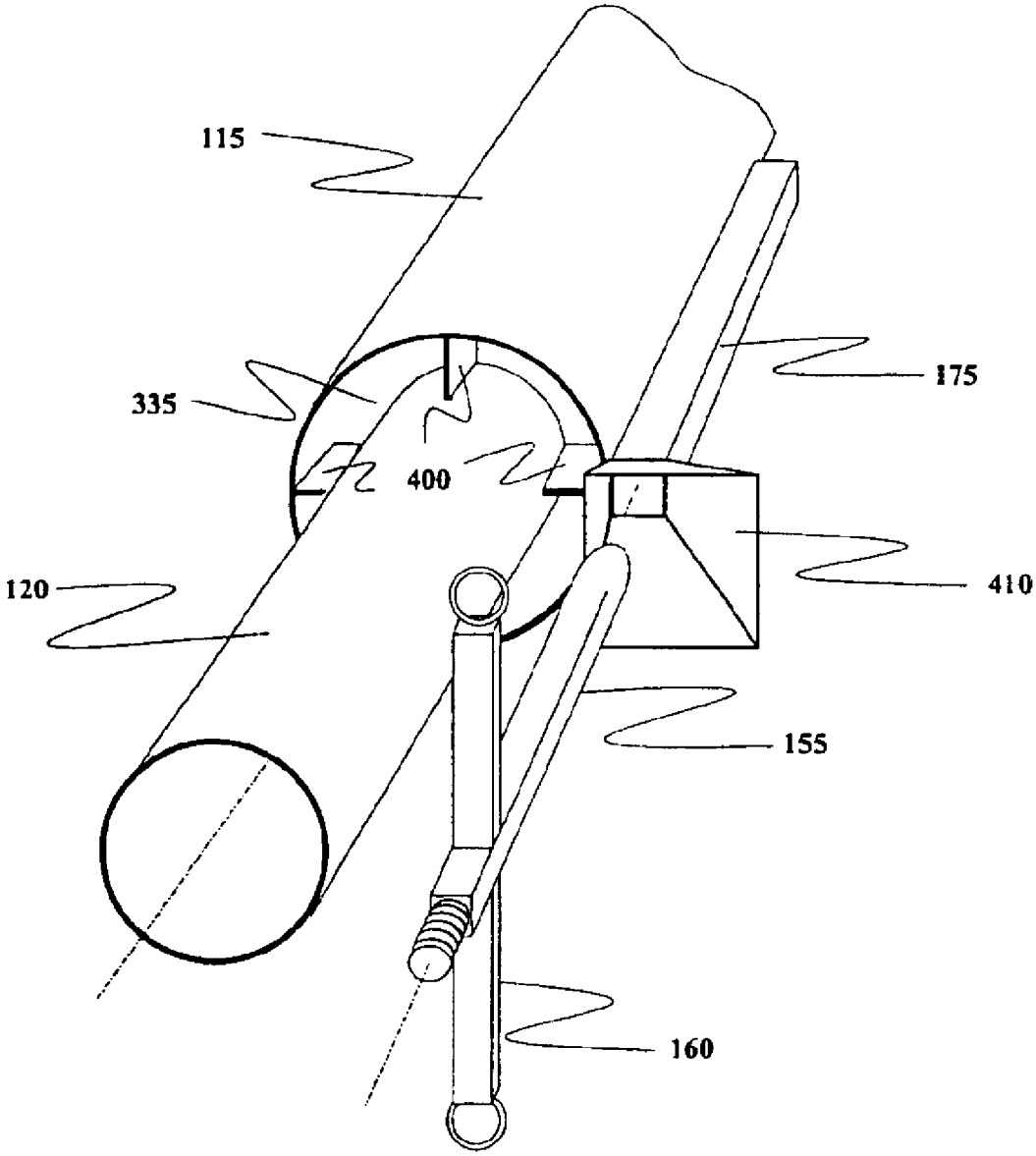
FIG. 4 is a perspective view of an alternative embodiment of a receptacle duct, showing a flow collimator, a support rod receptacle and a support rod.

A perspective view of an alternative embodiment of the connection between a flow collimator 120 and a receptacle duct 115 is depicted in FIG. 4. The flow collimator 120 is attached to the receptacle duct 115 by a series of fins 400. The fins 400 secure the separation between the flow collimator 120 and the receptacle duct 115 resulting in an air input port 335 at the first end of the receptacle duct 115.

Also depicted in FIG. 4 is a support rod receptacle 175 that is attached to the exterior of the receptacle duct 115. The support rod receptacle 175 is designed to receive a support rod 155 that is attached to the telescopic mast 150 of the portable installation apparatus 105 (not shown). The portable installation apparatus 105 may be removably connected to the portable discharging apparatus 100 by inserting the support rod 155 into the support rod receptacle 175. The support rod receptacle 175 may also include a flared termination 410 that is designed to guide the support rod 155 into the support rod receptacle 175 so that the portable discharging apparatus 100 may be readily coupled to and de-coupled from the portable installation apparatus 105. Further, the support rod receptacle 175 and the support rod 155 depicted in FIG. 4 have square cross-sectional areas adapted to prevent the rotation of the support rod receptacle 175 with respect to the support rod 155. The specific embodiment depicted in FIG. 4, also shows an oval point at the upper end of the support rod 155 for the purpose of facilitating the coupling of the support rod 155 with the support rod receptacle 175. Other forms of coupling may exist with corresponding mating cross-sections for the prevention of rotation such as a triangular cross-section, etc. Also depicted in FIG. 4 is the horizontal control rod 160, which may be used to stabilize and control the orientation of the portable discharging apparatus 100.

Figure 5A:
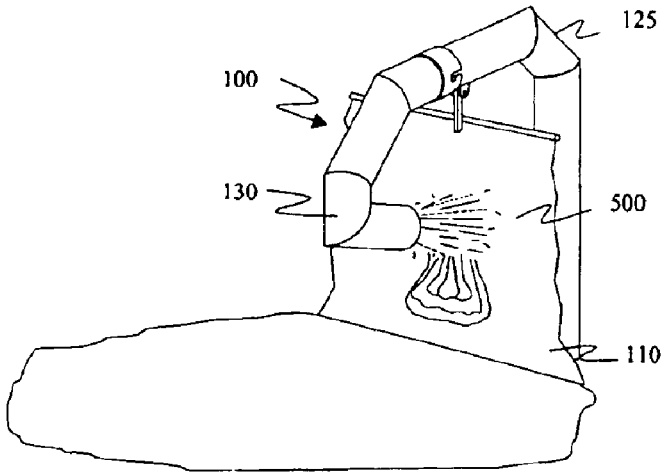
FIGS. 5A–5C are sequential perspective views showing a portable discharging apparatus and an arc-shaped flow discharge attachment issuing fire-fighting agents against the inside wall of a storage vessel.
Figure 5B:
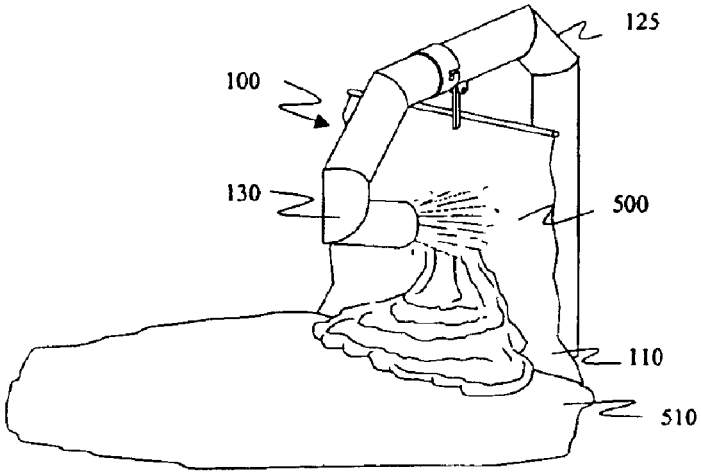
Figure 5C:
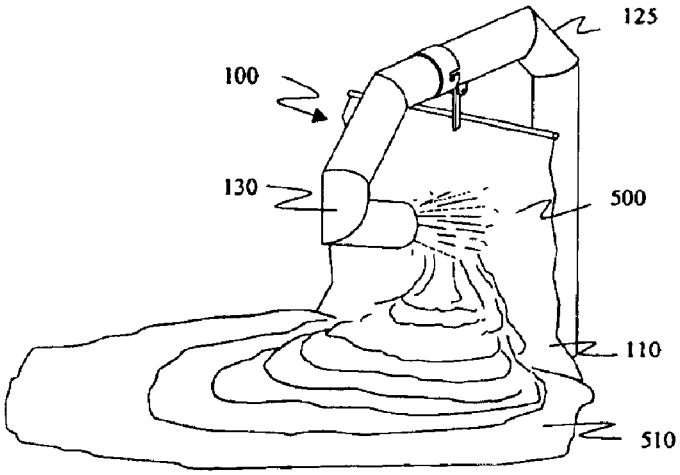

The use of one embodiment of the portable discharging apparatus 100 is depicted in FIGS. 5A–5C. In FIG. 5A, a portable discharging apparatus 100 has been mounted or placed on the upper edge of the wall of a storage vessel 110. In the depicted embodiment, an arc-shaped flow discharge attachment 130 is attached to the discharging duct 125, so that the fire-fighting agent 500 is directed against the inside wall of the storage vessel 110. The fire-fighting agent flows down and in contact with the inside wall of the storage vessel 110 as a thick, continuous cascade, as depicted in FIG. 5B. As the fire-fighting agent 500 continues to be applied, it will spread uniformly over the surface 510 of the burning liquid contained in the storage vessel 110, as depicted in FIG. 5C. Experience demonstrates that the disruptive effects of the fire on the fire-fighting agent layer, such as push back or disruption of the continuity of the fire-fighting agent layer is overcome by the back pressure that exists on the leading edge of the fire-fighting agent layer. This back pressure is generated from the location where the fire-fighting agent flows down the inside wall of the storage vessel 110 and comes in contact with the liquid contained in the storage vessel.

Eventually, as the fire-fighting agent continues to be issued from the portable discharging apparatus 100, the entire surface 510 of the burning liquid contained in the storage vessel 110 will be covered with the fire-fighting agent 500, thus cutting off the oxygen supply and extinguishing the fire.

In another embodiment of this invention, fire-fighting agents may be used also to extract heat from the burning liquid contained in the storage vessel 110. In this manner, the temperature of the burning liquid is lowered beneath the ignition point thus contributing to extinguishing the fire.

Figure 6A:
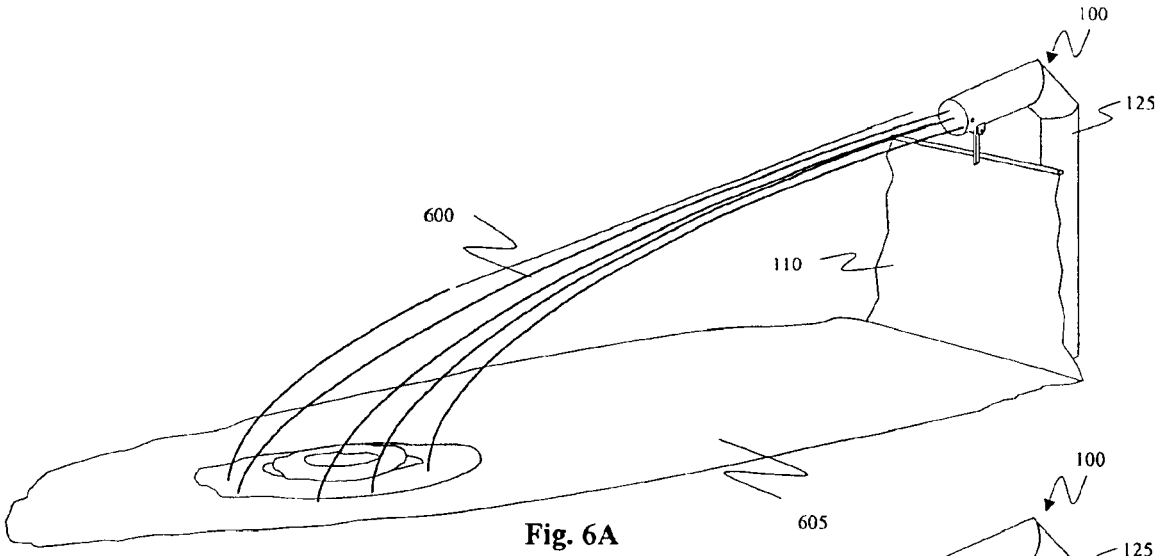
FIGS. 6A–6C are sequential perspective views showing another embodiment of a portable discharging apparatus, issuing fire-fighting agents directly onto the surface of the liquid in a storage vessel.
Figure 6B:
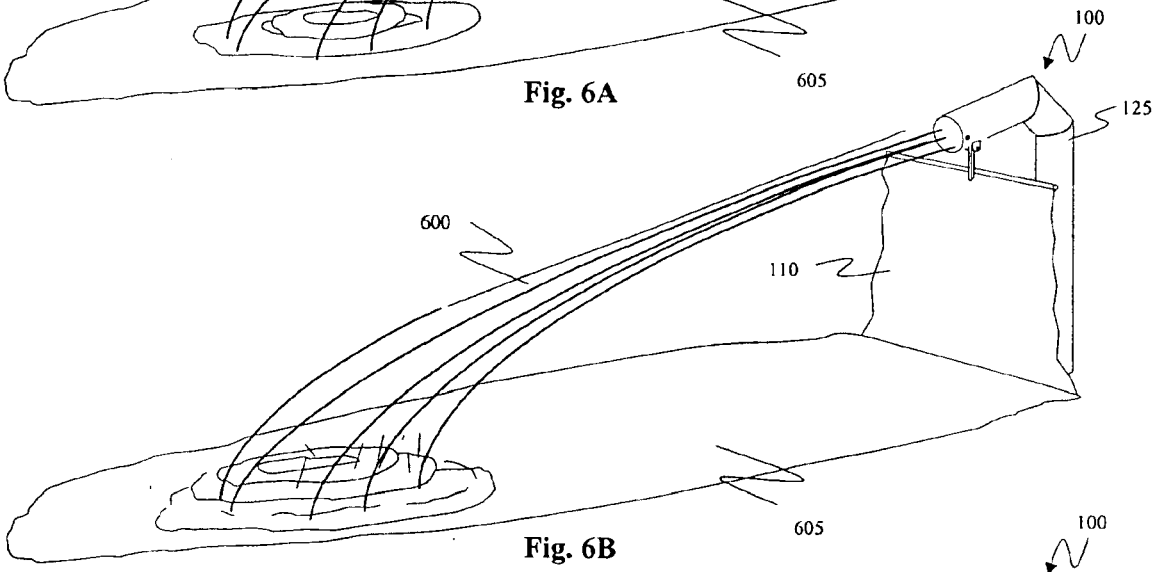
Figure 6C:
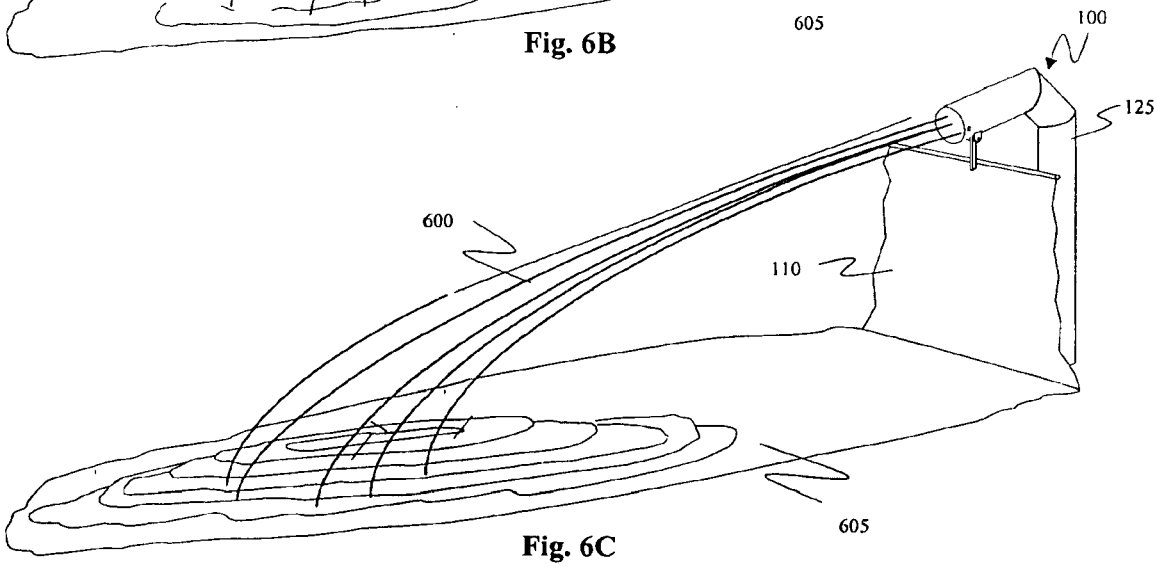

Another embodiment of the portable discharging apparatus 100 is depicted in FIGS. 6A–6C. In FIG. 6A, a portable discharging apparatus 100 is mounted or placed on the upper edge of the wall of a storage vessel 110. In this embodiment, however, the arc-shaped flow discharge attachment 130 is not utilized. Accordingly, the fire-fighting agent 500 that is discharged from the discharge duct 125 is aimed directly onto the surface 510 of the burning liquid contained in the storage vessel 110. Eventually, as the fire-fighting agent continues to be issued from the portable discharging apparatus 100, the entire surface 510 of the burning liquid contained in the storage vessel 110 will be covered with the fire-fighting agent 500, thus cutting off the oxygen supply and extinguishing the fire (FIGS. 6B & 6C). In this embodiment experience indicates that the disruptive effects of the fire may destroy the continuity of the fire-fighting agent layer thereby permitting the access of oxygen and delaying or preventing the extinction of the fire. In this embodiment it is recommended that several portable discharging apparatuses be mounted using only one portable installation apparatus 105 and used simultaneously to ensure the successful extinction of the fire.

The two embodiments depicted in FIGS. 5A–5C and 6A–6C, and other embodiments not specified here, can be used simultaneously given the flexible nature of the portable discharging apparatus 100 and the range of geometries available for the flow discharge attachments.

In another embodiment of this invention, fire-fighting agents may be used also to extract heat from the burning liquid contained in the storage vessel 110. In this manner, the temperature of the burning liquid is lowered beneath the ignition point thus contributing to extinguishing the fire.

Figure 7:
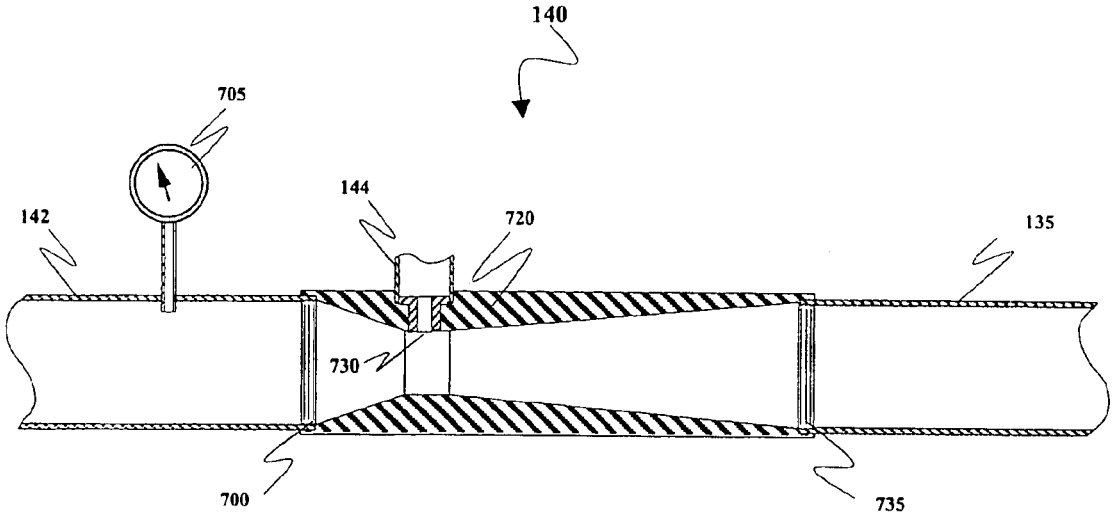
FIG. 7 is a longitudinal, cross sectional view of a mixing apparatus for mixing the fire-fighting agent with the conveyance medium according to one aspect of the invention.

A representative embodiment of a mixing apparatus 140 is depicted in FIG. 7. As described earlier with reference to FIG. 1A, the mixing apparatus 140 mixes a conveying media with a concentrated fire-fighting agent, such as a foaming mixture, and feeds this mixture into a supply hose 135. In FIG. 7, a conveyance media supply line 142 is provided to a first end 700 of the mixing apparatus 140. A pressure gauge 705 may be attached to the conveyance media supply line 142 to measure pressure. Within the mixing apparatus 140 is an inspirator 720. The inspirator 720 draws a supply of fire-fighting agent concentrate through the fire-fighting agent concentrate inlet 730 that it is mixed with the conveying media. The inside diameter of the fire-fighting agent concentrate inlet 730 is selected a priori to provide the required proportions of fire-fighting agent concentrate and conveying media. A fire-fighting agent supply line 144 is attached to the fire-fighting agent concentrate inlet 730 to provide fire-fighting agent concentrate to the mixing apparatus 140. Thus, at the second end 735 of the mixing apparatus 140, a mixture of a conveying media and fire-fighting agent concentrate is provided to a fire-fighting agent supply hose 135.

Figure 8A:
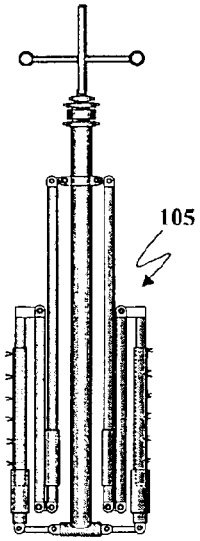
FIG. 8A is a front view of an alternative embodiment of a portable installation apparatus with the telescopic mast fully retracted and the foldable base tube and foldable lateral support struts fully folded into a compact structure.
Figure 8B:
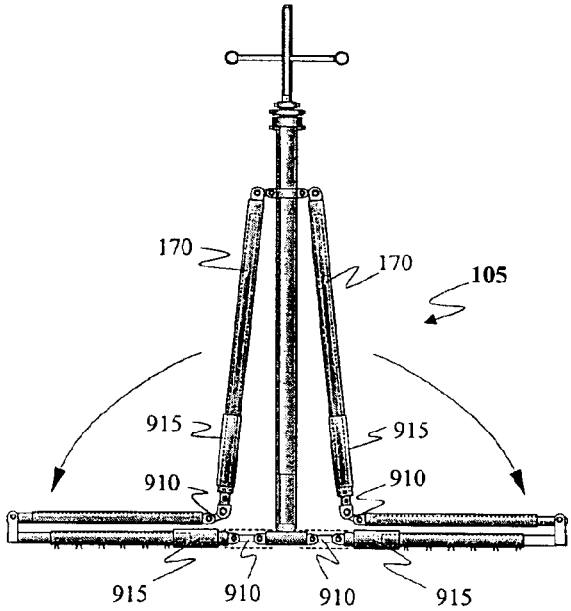
FIG. 8B is a front view of an alternative embodiment of a portable installation apparatus with the telescopic mast fully retracted and the foldable base tube and foldable lateral support struts partially folded into a more compact structure.
Figure 8C:
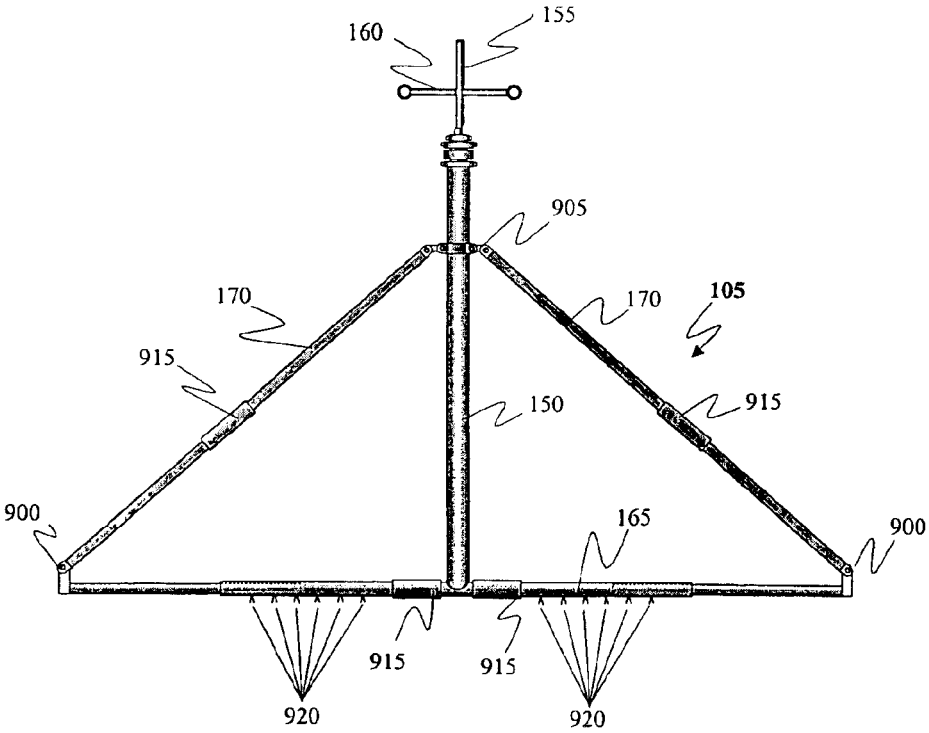
FIG. 8C is a front view of an alternative embodiment of a portable installation apparatus with the telescopic mast fully retracted and the foldable base tube and foldable lateral support struts fully extended.

A representative embodiment of the portable installation apparatus 105 is depicted in FIGS. 8A–8C. A fully assembled portable installation apparatus 105 is depicted in FIG. 8A. As previously described, the portable installation apparatus 105 may be comprised of a telescopic mast 150, a base tube 165, and a pair of lateral support struts 170. Each of the lateral support struts 170 is attached to a respective end of the base tube 165 by couplers 900. The other ends of the lateral support struts 170 are coupled to a collar 905 that is attached to the telescopic mast 150. A support rod 155 and a horizontal control rod 160 may be attached to the distal end of the telescopic mast 150. As previously described, the support rod 155 may be used for attaching the portable discharging apparatus 100 onto the distal end of the telescopic mast 150. The horizontal control rod 160, when used with tether lines 185, provides vertical stability to the telescopic mast 150 and the horizontal orientation to the portable discharging apparatus 100 as it is mounted or placed on the upper edge of the wall of a storage vessel 110.

According to another aspect of the invention, the portable installation apparatus 105 may be collapsed into a unit that may be readily folded and stored. This embodiment is depicted in FIGS. 8B & 8C. In FIG. 8B, the base tube 165 and each of the lateral support struts 170 further comprising pivotal joints 910, which allow the rigid members to be folded into a more compact arrangement. A fully collapsed and folded embodiment of the portable installation apparatus 105 is depicted in FIG. 8C. Each of the flexible joints 910 has a corresponding sliding cover 915 that is used to lock the joint 910 when the portable installation apparatus 105 is fully extended and deployed. For example, in FIG. 8A, the sliding covers 915 have been deployed over the flexible joints 910 to maintain the rigidity of the respective lateral support struts 170 and the rigidity of the base tube 165. Also depicted in FIG. 8A are the base anchors 920, which are used to secure the base tube 165 to the ground or other surfaces as the portable discharging apparatus 100 is elevated and mounted or placed on the upper edge of the wall of a storage vessel 110.

Figure 9A:
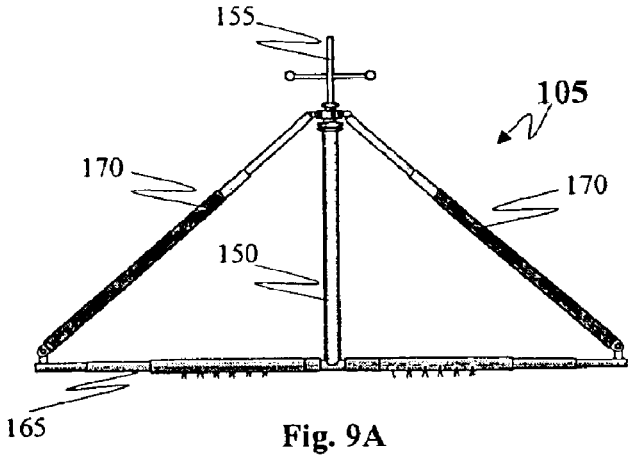
FIG. 9A is a front view of an alternative embodiment of a portable installation apparatus with telescopic mast fully retracted and the expandable, telescopic base tube and the expandable, telescopic lateral support struts in the fully retracted position.

In another embodiment of the inventions the base tube 165, the lateral support struts 170 and the telescopic mast 150 are comprised of telescopic members that can readily be extended or contracted so that the portable installation apparatus 105 can be used with a wide variety of sizes of storage vessels. This concept is illustrated in FIGS. 9A–9E. In FIG. 9A, an embodiment of the portable installation apparatus 105 is depicted in which the members of the telescopic mast 150, base tube 165 and the lateral support struts 170 are in their respected contracted positions.

Figure 9B:
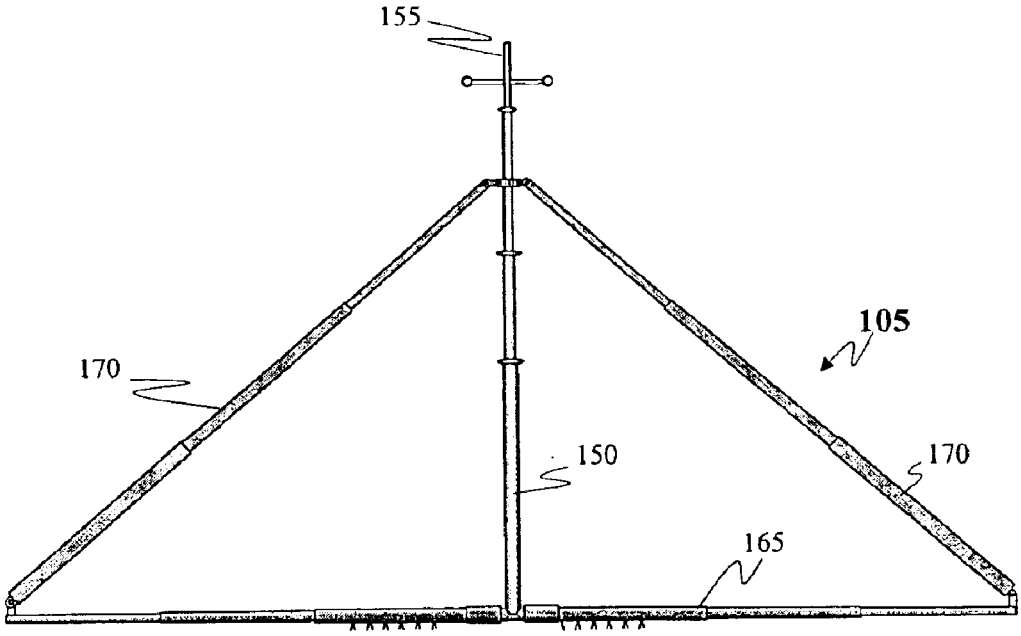
FIG. 9B is a front view of an alternative embodiment of a portable installation apparatus in which the telescopic mast, the telescopic base tube and the telescopic lateral support struts are all partially extended.
Figure 9C:
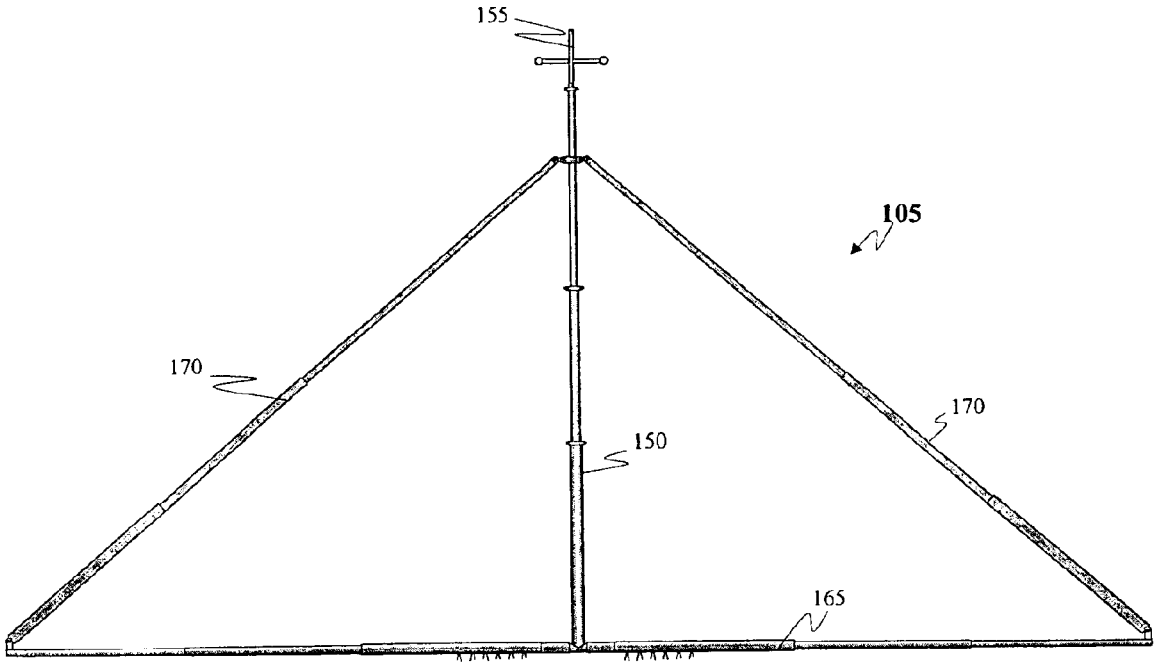
FIG. 9C is a front view of an alternative embodiment of a portable installation apparatus in which the telescopic mast, the telescopic base tube and the telescopic lateral support struts have all been fully extended.

In FIG. 9B, the telescopic mast 150, the base tube 165, and the lateral support struts 170 are partially extended to such a position that may allow the portable discharging apparatus 100, attached to the support rod 155 at the distal end of the telescopic mast 150, to be mounted or placed on the upper edge of the wall of a storage vessel 110, having a relatively medium height. In FIG. 9C, the telescopic mast 150, the base tube 165 and the lateral support struts 170 are fully extended so that the portable discharging apparatus 100 attached to support rod 155 at the distal end of the telescopic mast 150 may be mounted or placed on the upper edge of the wall of a storage vessel 110, having a relatively higher height.

Figure 9D:
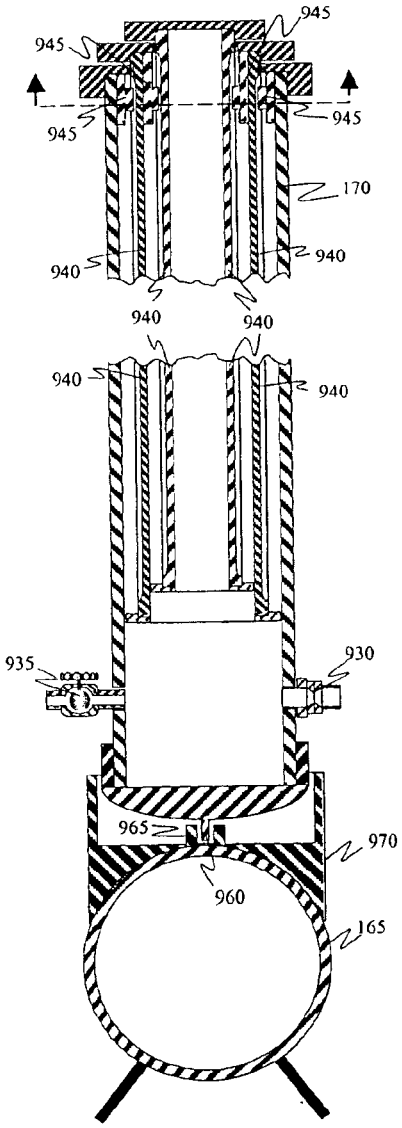
FIG. 9D is a longitudinal cross-sectional view of an alternative embodiment of the telescopic mast showing the inner locking arrangement between the telescoping cylinders and between the mast and the base tube.
Figure 9E:
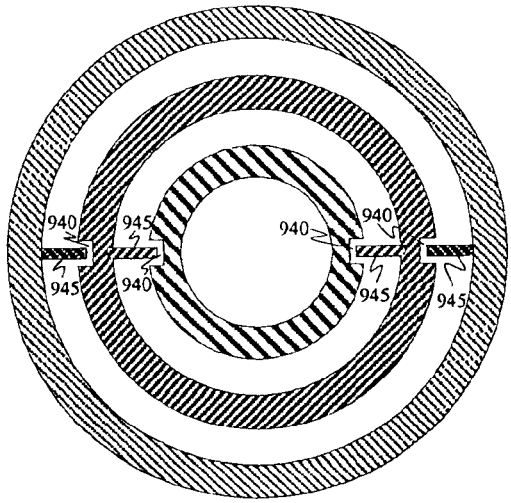
FIG. 9E is a transverse cross-sectional view of an alternative embodiment of the telescopic mast showing the inner locking arrangement between the telescoping cylinders.

In FIGS. 9D and 9E an embodiment of an arrangement of locks and keys are depicted to prevent the rotation the members of the telescopic mast 150 with respect to the base tube 165 and thus secure the transverse angular orientation of the portable discharging apparatus 100, as it is mounted or placed on the upper edge of the wall of a storage vessel 110. In FIG. 9D, a longitudinal cross-section of an embodiment of the interior of the telescopic mast 150 is depicted in which an arrangement of a key 960 is attached to the base of the telescopic mast 150. A U-shaped grove 965 is attached to the base support socket 970, which is attached to the base tube 165. The key 960 mates with the U-shaped grove 965 so as to prevent the rotation of the exterior member of the telescopic mast 150 about the longitudinal centerline of the telescopic mast 150 with respect to the longitudinal centerline of the base tube 165.

In FIG. 9E, a transverse cross-section view of one embodiment of the telescopic mast 150 illustrates an embodiment of inner locking devices, between adjacent telescopic sections, which prevent the rotation of the telescopic mast 150 with respect to the longitudinal center line of the base tube 165. Thus, the alignment of the base tube 165 with respect to the storage vessel 110 is maintained throughout the entire length of the portable installation apparatus 105. This specific embodiment uses an arrangement of a keyed collar 945 attached to the inner wall of a telescopic section and a grove 940 along the entire length of the outer wall of the next inner telescopic section, as showed in FIGS. 9D-9E. Other suitable arrangements of inner locks will be apparent to one of ordinary skill for the prevention of rotation between the telescopic sections, such as inverting the key and the grove arrangement or using rectangular telescopic sections or other such means.

FIG. 9D also depicts an embodiment of a bi-directional flow apparatus 930 for incoming or outgoing hydraulic flow in the hydraulic line 192 (not shown), and is adapted to prevent the loss of hydraulic pressure in the interior of the telescopic mast 150 when the hydraulic line 192 is removed either intentionally or accidentally. Also depicted in FIG. 9D is an embodiment of a drain apparatus 935. One aspect of the drain apparatus 935 is the removal of the residual hydraulic fluids prior to the storage of the portable installation apparatus 105. This prevents corrosion of the inner cavities of the telescopic mast 150 when not in operation. The second aspect of the drain apparatus 935 is the relief of hydraulic pressure in the telescopic mast 150 for the purpose of preventing damage to the seals and compromising structural integrity of the telescopic members.

Figure 10A:
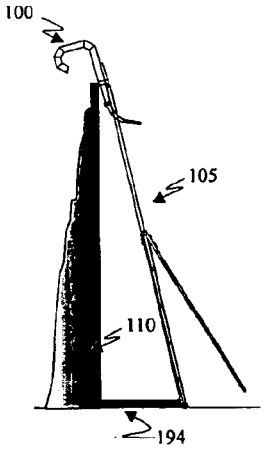
FIGS. 10A-C are side views of one embodiment of the invention, showing the increase in the separation distance between the base of the portable installation apparatus and the bottom of the wall of the storage vessel for three increasing storage vessel wall heights.
Figure 10B:
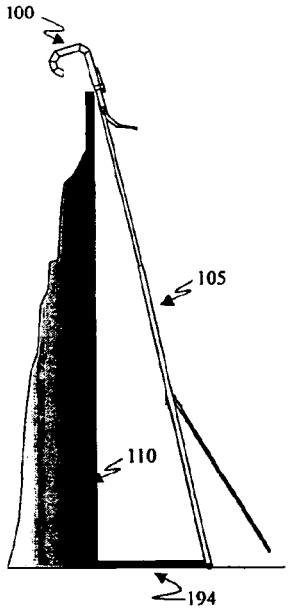
Figure 10C:
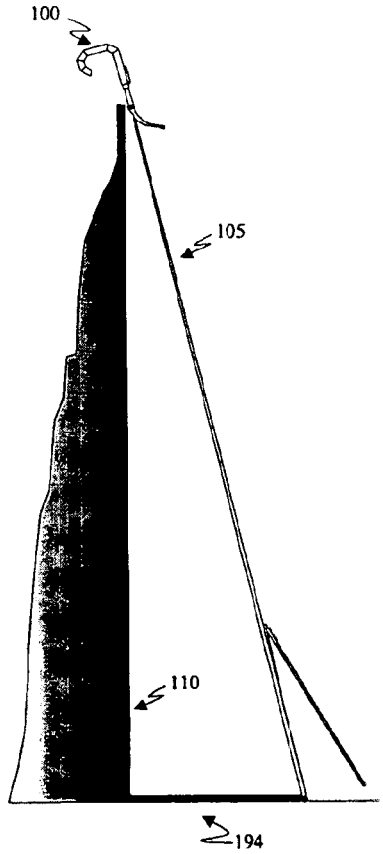

FIGS. 10A–10C depict the key difference in the process of mounting the portable discharging apparatus 100 on storage vessels 110 of varying heights. The length of the spacer member 194 can be adjusted to preset lengths corresponding to different heights of the storage vessel 110 or flexibly adjusted on site in response to the actual environment and available space. The spacer bar 194 serves to fix the distance between the bottom of the wall of the storage vessel 110 and the base tube 165 of the portable installation apparatus 105 and to achieve the correct degree of inclination of the portable installation apparatus 105, to ensure the directional stability of the apparatus as it is elevated to mount or remove the portable discharging apparatus 100.

FIGS. 11A–11E depict another aspect of the invention wherein a conveying embodiment for the purpose of transporting the fire-fighting apparatuses of the present invention is shown.

Figure 11A:
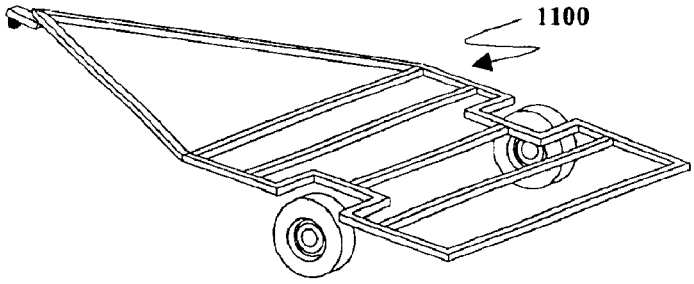
FIG. 11A is a perspective view of an alternative embodiment of a transportation apparatus for a skid, a portable installation apparatus, a portable discharging apparatus and accessories.

In FIG. 11A a transportation apparatus 1100 is shown, which is adapted to be either manually maneuvered or mechanically towed to the site of the burning storage vessel 110. The transportation apparatus 1100 is further adapted to carry the portable discharging apparatus 100, the portable installation apparatus 105 and accessories on board.

Figure 11B:
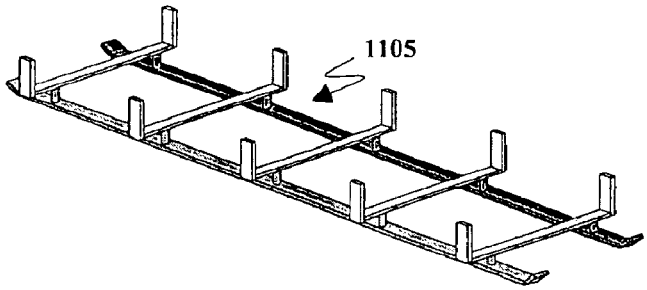
FIG. 11B is a perspective view of an alternative embodiment of a skid for a portable installation apparatus, a portable discharging apparatus and accessories.

In FIG. 11B a skid 1105 is shown, which is a further embodiment of the present invention that is adapted for containing and transporting the fire-fighting apparatuses. The skid 1105 is designed such that it can be transported in a variety of ways, including a trailer, a railcar, a truck, a boat, or a helicopter. In addition, the skid 1105 is designed such that it can be pulled or carried across a variety of surfaces so that all of the components of the present invention can be readily transported to the immediate vicinity of the fire.

Figure 11C:
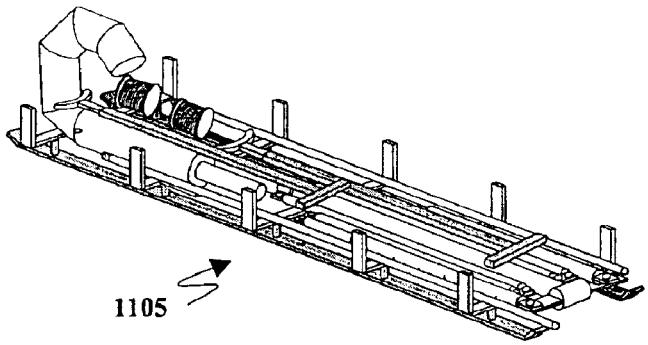
FIG. 11C is a perspective view of the major components of a portable installation apparatus, a portable discharging apparatus and accessories according to an embodiment of the invention.

In FIG. 11C the portable discharging apparatus 100 and the portable installation apparatus 105 are loaded in the skid 1105, wherein the entire fire-fighting apparatuses and accessories of the present invention may be readily transported and deployed at the location of a fire.

Figure 11D:
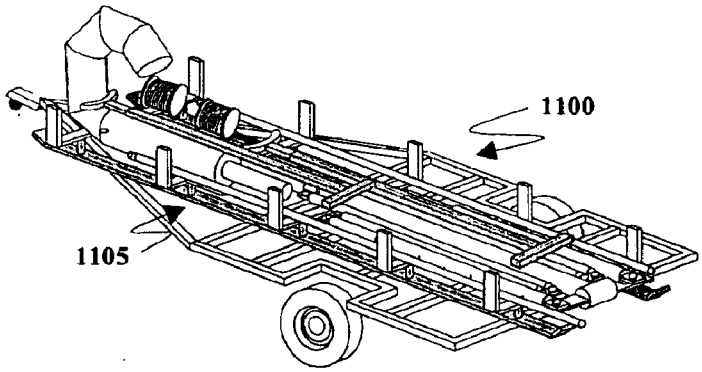
FIG. 11D is a perspective view of one aspect of the invention depicting the assembly of a portable installation apparatus and a portable discharging apparatus.

In FIG. 11D depicts the skid 1105 loaded with the portable discharging apparatus 100, the portable installation apparatus 105 and accessories onboard the transportation apparatus 1100.

Figure 12A:
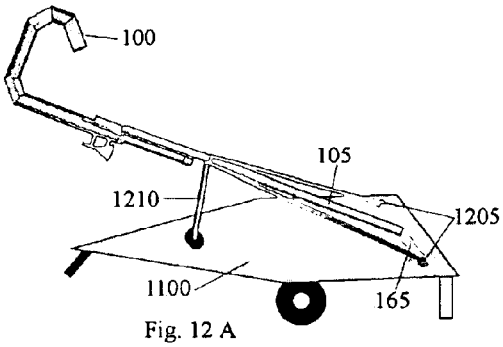
FIGS. 12A–12C are sequential perspective views of one aspect of the invention depicting a method for deploying the assembled portable installation apparatus and the portable discharging apparatus, on board the transportation apparatus to the storage vessel.
Figure 12B:
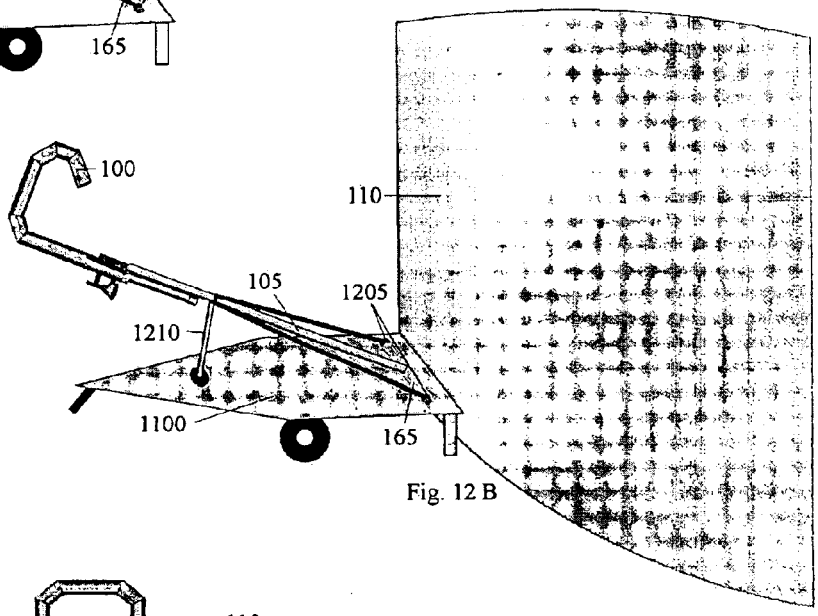
Figure 12C:
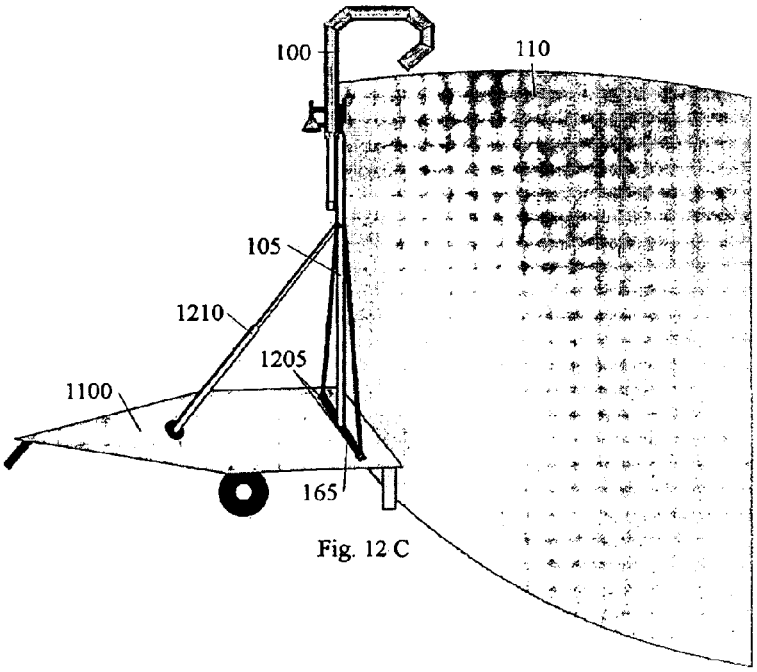

A perspective view of an alternative embodiment of the present invention is illustrated in the FIGS. 12A–12C, wherein the portable installation apparatus 105, and the portable discharging apparatus 100, are fully assembled on board the transportation apparatus 1100. Specifically, the transportation apparatus 1100 is adapted to move the assembled portable installation apparatus 105 with the portable discharging apparatus 100 from a distant assembly point to the wall of the storage vessel 110. In this embodiment of the invention, the portable installation apparatus 105 is adapted with a second telescopic device 1210, wherein the second telescopic device 1210 is adapted to erect the portable installation apparatus 105 together with the portable discharging apparatus 100 to the full upright position using two mounting trunnions 1205, that mate with each end of the base tube 165. The two mounting trunnions 1205 together with the ends of the base tube 165 provide for the erective rotation and locking of the portable installation apparatus in the full upright position. One of ordinary skill in the art will recognize that other arrangements may be utilized in the assembly, transporting and erecting the portable installation apparatus.

Although certain embodiments and aspects of the present inventions have been illustrated in the accompanying drawings and described in the foregoing detailed descriptions, it will be understood that the inventions are not limited to the embodiments disclosed. Further, the inventions are capable of numerous rearrangements, modifications and substitutions without departing from the spirit of the invention as set forth and defined by the following claims and equivalents thereof. The Applicants intend that the claims shall not invoke the application of 35 U.S.C. § 112, ¶ 6 unless the claim is explicitly written in means-plus-function or step-plus-function format.

We claim:

1. A fire-fighting system for fighting fires in a storage vessel, the system comprising:

a) a portable discharging apparatus that can be removably mounted on a storage vessel, the portable discharging apparatus comprising:
- a receptacle duct adapted to receive a supply of a fire-fighting agent;
- an air input port attached to the receptacle duct, the air input port adapted to aerate the fire-fighting agent;
- a first passage duct attached to a receptacle duct, the passage duct adapted to receive a second supply of a fire-fighting agent;
- a support rod receptacle attached to the receptacle duct;
- a vessel mounting apparatus adapted to removably attach the portable discharging apparatus to a storage vessel; and
- a discharge duct adapted to discharge a fire-fighting agent received from the receptacle duct;

b) a portable installation apparatus adapted to removably mounted to a portable discharging apparatus on the storage vessel, the portable installation apparatus comprising:
- a longitudinally extendable telescopic mast having a proximal end and a distal end;
- a support rod affixed at the distal end of the telescopic mast, wherein the support rod is adapted to be removably connected to the support rod receptacle of the portable discharging apparatus; and
- a plurality of locking devices adapted to maintain a fixed orientation of the portable discharging apparatus, wherein the telescopic mast may be used to removably mount a portable discharging apparatus on a top perimeter of the storage vessel.

2. A fire-fighting system according to claim 1, wherein the portable discharging apparatus further comprises an arc-shaped discharge attachment connected to the discharge duct wherein the arc-shaped discharge attachment is adapted to receive a mixture of fire-fighting agent and air and direct the mixture against an inside wall of the storage vessel.

3. A fire-fighting system according to claim 2, wherein the portable discharging apparatus further comprises at least one passage duct attached to the discharge attachment and adapted to receive a supply of a fire-fighting agent and direct the fire-fighting agent against an inside wall of a storage vessel.

4. A fire-fighting system according to claim 1, wherein the portable discharging apparatus further comprises a flow collimator having a first end and a second end wherein the second end is positioned inside the receptacle duct and wherein the first end is adapted to receive a supply of fire-fighting agent and provide a substantially uniform flow of the fire-fighting agent at the second end.

5. A fire-fighting system according to claim 4, wherein the portable discharging apparatus further comprises a jet stream enhancer plate connected to the second end of the flow collimator, the jet stream enhancer plate adapted to induce a mixture of the fire-fighting agent and air provided by the air input port.

6. A fire-fighting system according to claim 1, wherein the portable discharging apparatus further comprises a first rigid device connected to the receptacle duct and extending in a radial direction from the receptacle duct wherein the first rigid device is adapted to maintain a spacing between the receptacle duct and the wall of the storage vessel.

7. A fire-fighting system according to claim 6, wherein the portable discharging apparatus further comprises a second rigid device connected to the receptacle duct and extending in a radial direction from the receptacle duct wherein the first and second rigid devices are adapted to maintain the stability and orientation of the mobile discharging apparatus on the top perimeter of the storage vessel.

8. A fire-fighting system according to claim 1 wherein the portable installation apparatus further comprises a longitudinally extendable base tube wherein the proximal end of the telescopic mast is mounted to a central receptacle of the base tube.

9. A fire-fighting system according to claim 8 wherein the portable installation apparatus further comprises a telescopic mast wherein the proximal end of the telescopic mast is adapted to lock the proximal end of the telescopic mast to the central receptacle of the base tube.

10. A fire-fighting system according to claim 8 wherein the portable installation apparatus further comprises a telescopic mast wherein the proximal end of the telescopic mast is adapted to prevent the angular rotation of the telescopic mast about the longitudinal center line of the telescopic mast with respect to the longitudinal center line of the base tube.

11. A fire-fighting system according to claim 1 wherein the portable installation apparatus further comprises a pair of longitudinally extendible lateral support struts wherein first end of each lateral support strut is connected to a collar that is coupled to the telescopic mast and wherein a second end of each lateral support strut is connected to respective ends of the base tube.

12. A fire-fighting system according to claim 1 wherein the telescopic mast, the base tube and the lateral support struts can be assembled in a substantially triangular shape and wherein the height of the portable installation apparatus can be adjusted to correspond to the height of the storage vessel.

13. A fire-fighting system according to claim 1, further comprising a transportation apparatus for carrying at least one portable discharging apparatus and at least one portable installation apparatus.

14. A fire-fighting system according to claim 13, wherein the transportation apparatus comprises a deployable skid adapted to contain the components of the fire-fighting system.

15. A fire-fighting system according to claim 13, wherein the transportation apparatus is further adapted to erect the portable installation apparatus using an erecting device, wherein the erecting device comprises a rotary attachment that is adapted to mate with the proximal end of the telescopic mast and lock in an upright position.

16. A fire-fighting system according to claim 1, further comprising a mixing apparatus adapted to mix a fire-fighting agent with a conveying media and supply the mixture to a receptacle duct of a portable discharging apparatus.

17. A portable discharging apparatus adapted for fighting fires in a storage vessel, the apparatus comprising:

a receptacle duct adapted to receive a supply of a fire-fighting agent;

an air input port attached to the receptacle duct, the air input port adapted to aerate the fire-fighting agent;

a first passage duct attached to a receptacle duct, the passage duct adapted to receive a second supply of a fire-fighting agent;

a support rod receptacle attached to the receptacle duct;

a vessel mounting apparatus adapted to removably attach the portable discharging apparatus to a storage vessel; and a discharge duct adapted to discharge a fire-fighting agent received from the receptacle duct.

18. A portable discharging apparatus according to claim 17 further comprising an arc-shaped discharge attachment connected to the discharge duct wherein the arc-shaped discharge attachment is adapted to receive the fire-fighting agent and direct the fire-fighting agent against an inside wall of a storage vessel.

19. A portable discharging apparatus according to claim 18 further comprising a second passage duct connected to the arc-shaped discharge attachment, the second passage duct adapted to receive a fire-fighting agent and direct the fire-fighting agent against the inside wall of a storage vessel.

20. A portable discharging apparatus according to claim 17 further comprising:

a flow collimator having a first end and a second end wherein the second end is positioned inside the receptacle duct and wherein the first end is adapted to receive a supply fire-fighting agent and provide a substantially uniform flow of the fire-fighting agent at the second end; and a jet stream enhancer plate connected to the second end of the flow collimator, the jet stream enhancer plate adapted to induce a mixture of the fire-fighting agent with air provided by the air input port.

21. A portable discharging apparatus according to claim 17 further comprising a first rigid device connected to the receptacle duct and extending in a radial direction from the receptacle duct wherein the first rigid device is adapted to maintain a spacing between the receptacle duct and the storage vessel.

22. A portable discharging apparatus according to claim 21 further comprising a second rigid device connected to the receptacle duct and extending in a radial direction from the receptacle duct wherein the first and the second rigid devices are adapted to maintain the stability and orientation of the portable discharging apparatus on the top perimeter of the storage vessel.

23. A portable installation apparatus adapted to removably mount a portable discharging apparatus on a storage vessel, the portable installation apparatus comprising:

a longitudinally extendable telescopic mast having a proximal end and a distal end;

a support rod affixed at the distal end of the telescopic mast, wherein the support rod is adapted to be removably connected to a support rod receptacle of the portable discharging apparatus; and a plurality of locking devices adapted to maintain a fixed orientation of the portable discharging apparatus with respect to the storage vessel, wherein the proximal end of the telescopic mast is removeably couplable to a top perimeter of the storage vessel.

24. A portable installation apparatus according to claim 23, further comprising:

a support pedestal adapted to support the telescopic mast during assembly of the portable installation apparatus with the portable installation apparatus; and a spacer member adapted to maintain a fixed distance between the portable installation apparatus and the storage vessel wall.

25. A portable installation apparatus according to claim 23, further comprising a longitudinally extendable base tube wherein the proximal end of the telescopic mast is adapted to be inserted into a base support socket of the base tube.

26. A portable installation apparatus according to claim 25, wherein the proximal end of the telescopic mast is adapted to lock the proximal end of the telescopic mast to the base support socket of the base tube.

27. A portable installation apparatus according to claim 26, wherein the proximal end of the telescopic mast is adapted to prevent the angular rotation of the proximal end of the telescopic mast about the longitudinal center line of the telescopic mast with respect to the longitudinal center line of the base tube.

28. A portable installation apparatus according to claim 25, further comprising a pair of longitudinally extendible lateral support struts wherein a first end of each lateral support strut is connected to a collar that is coupled to the telescopic mast and wherein a second end of each lateral support strut is connected to respective ends of the base tube.

29. A portable installation apparatus according to claim 28 wherein the telescopic mast, the base tube, and the lateral support struts can be assembled in a substantially triangular shape and wherein a height of the portable installation apparatus can be adjusted to correspond to a height of the storage vessel.

30. A portable installation apparatus according to claim 23 wherein the telescopic mast further comprises:

at least two concentric hollow members; and at least one locking device disposed between adjacent hollow members, the locking devices adapted to prevent rotation of the hollow members about the longitudinal axis of the telescopic mast.

31. A portable installation apparatus according to claim 25 wherein the telescopic mast further comprises:

a lock joint between the proximal end of the telescopic mast and a receptacle mounted on the base tube, the lock joint adapted to prevent the rotation of the telescopic mast about its longitudinal axis with respect to the base tube.

32. A portable installation apparatus according to claim 25 wherein the base tube further comprises:

a set of first pivotable joints and a corresponding set of first slidable covers wherein the first set of pivotable joints permit the base tube to be folded into a direction that is generally aligned with the telescopic mast, and wherein the first slidable covers are adapted to lock the first pivotal joints in an extended position when the first covers are placed over the corresponding first pivotable joints, and wherein the first sliding covers permit the first pivotable joints to be folded when removed from the first pivotable joints.

33. A portable installation apparatus according to claim 28 wherein the lateral support struts further comprise:

a set of second pivotable joints and a corresponding set of second slidable covers wherein the second pivotable joints permit the lateral support struts to be folded into a direction that is generally aligned with the telescopic mast, and wherein the second slidable covers are adapted to lock the second pivotable joints in an extended position when the second slidable covers are placed over the corresponding second pivotable joints, and wherein the second slidable covers permit the second pivotable joints to be folded when removed from the second pivotable joints.

34. A portable installation apparatus according to claim 23 wherein the telescopic mast further comprises a first hydraulic apparatus adapted to connect a hydraulic line to the telescopic mast so that the telescopic mast may be extended by injecting hydraulic fluid into the telescopic mast and retracted by removing hydraulic fluid from the telescopic mast.

35. A portable installation apparatus according to claim 34 wherein the telescopic mast further comprises a second hydraulic apparatus adapted for removing hydraulic fluid from the telescopic mast prior to storage of the telescopic mast.

36. A portable installation apparatus according to claim 35 wherein the telescopic mast further comprises a third hydraulic apparatus adapted to prevent excessive hydraulic pressures from developing within the interior of the telescopic mast.

37. A portable installation apparatus according to claim 36 wherein the telescopic mast further comprises a fourth hydraulic apparatus adapted to prevent a loss of hydraulic pressure from within the interior of the telescopic mast when a hydraulic line is removed from the first hydraulic apparatus.

38. A method for applying fire-fighting agents onto a storage vessel, the method comprising:

providing a portable discharging apparatus comprising a receptacle duct, an air input port attached to the receptacle duct, a first passage duct attached to a receptacle duct, a support rod receptacle attached to the receptacle duct, a vessel mounting apparatus, and a discharge duct;

providing a portable installation apparatus comprising a longitudinally extendable telescopic mast having a proximal end and a distal end, a support rod affixed at the distal end of the telescopic mast, and a plurality of locking devices adapted to maintain a fixed orientation of the portable discharging apparatus, attaching the support rod receptacle of the portable discharging apparatus to the support rod of the telescopic mast;

extending the telescopic mast of the portable installation apparatus to a length corresponding to a height of the storage vessel;

pivoting the telescopic mast about its proximal end so that the portable discharging apparatus is adjacent to an upper edge of the storage vessel;

attaching the vessel mounting apparatus to the upper edge of the storage vessel; and providing a supply of fire-fighting agent to the portable discharging apparatus so that the fire-fighting agent is discharged from the discharge duct.

39. A method according to claim 38, further comprising providing a transportation apparatus for carrying the portable discharging apparatus and the portable installation apparatus to a desired location.

40. A method according to claim 38, further comprising placing a spacer member between the portable installation apparatus and a wall of the storage vessel.

41. A method according to claim 38, further comprising removing the support rod of the telescopic mast from the support rod receptacle of the portable discharging apparatus.

42. A method according to claim 38, further comprising stabilizing an orientation of the portable discharging apparatus with at least one tether line and at least one stabilizing rod.

43. A method according to claim 38, further comprising directing the fire-fighting agents against an inside wall of the storage vessel.

44. A method, according to claim 38, further comprising directing the fire-fighting agents onto an upper surface of the storage vessel.

45. A method according to claim 38, wherein the step of extending the telescopic mast further comprises:

connecting a hydraulic line to a first hydraulic apparatus at the proximal end of the telescopic mast; and injecting hydraulic fluid from the hydraulic line into the telescopic mast.

46. A method according to claim 38, further comprising:

providing a second portable discharging apparatus comprising a receptacle duct, an air input port attached to the receptacle duct, a first passage duct attached to a receptacle duct, a support rod receptacle attached to the receptacle duct, a vessel mounting apparatus, and a discharge duct;

attaching the support rod receptacle of the second portable discharging apparatus to the support rod of the telescopic mast;

extending telescopic mast of the portable installation apparatus to a length corresponding to a height of the storage vessel;

pivoting the telescopic mast about its proximal end so that the second portable discharging apparatus is adjacent to an upper edge of the storage vessel;

attaching the vessel mounting device of the second portable discharging apparatus to the upper edge of the storage vessel at a location spaced apart from the previously attached portable discharging apparatus; and providing a fire-fighting agent to the second portable discharging apparatus so that the fire-fighting agent is discharged from the discharge duct.

47. A fire-fighting system for fighting fires in a storage vessel, the apparatus comprising:

a) a portable discharging apparatus that can be temporarily attached to an upper ridge on the storage vessel, the portable discharging apparatus comprising:

a cylindrical flow collimator adapted to receive a first supply of a fire-fighting agent at a first end and provide a substantially uniform flow of the fire-fighting agent at a second end;

a receptacle duct having a first end surrounding the second end of the flow collimator, wherein the gap between the first end of the receptacle duct and the second end of the flow collimator defines an air input port, wherein the air input port is adapted to provide air for mixing with the fire-fighting agent;

at least one passage duct attached to the receptacle duct wherein the passage duct is adapted to receive a second supply of fire-fighting agent;

a jet stream enhancer plate connected to the second end of the flow collimator, the jet stream enhancer plate adapted to increase the velocity of the fire-fighting agent flow and direct the ejected stream of the fire-fighting agent to collide with air provided by the air input port;

a support rod receptacle attached to the exterior of the receptacle duct;

a first rigid device connected to the receptacle duct and extending in a radial direction from the receptacle duct wherein the first rigid device is adapted to maintain a spacing between the cylindrical receptacle duct and the storage vessel;

a discharge duct connected to the receptacle duct wherein the discharge duct is adapted to receive a supply of fire-fighting agent and air from the receptacle duct and discharge the mixture in a specific direction onto the surface of the storage vessel; and at least on passage duct attached to the discharge duct wherein the passage duct is adapted to receive at least one other supply of a fire-fighting agent and discharge the fire-fighting agent in a specific direction onto the storage vessel;

a second rigid device connected to the discharge duct and extending in a radial direction from the discharge duct wherein the second rigid device is adapted to attach to the upper ridge on the storage vessel; and a mixing apparatus for mixing a fire-fighting agent with a conveying media.

b) a portable installation apparatus adapted to mount a portable discharging apparatus to an upper edge of the storage vessel, the portable installation apparatus comprising:

a longitudinally extendable telescopic mast having a proximal end and a distal end wherein the length of the telescopic mast may be controlled by providing or removing a fluid from within the telescopic mast;

a support rod affixed at the distal end of the central mast, wherein the support rod may be removably coupled to the support rod receptacle of the portable discharging apparatus;

a longitudinally extendable base tube wherein the proximal end of the telescopic mast is fixed to a central portion of the base tube;

a pair of longitudinally extendible lateral support struts wherein a first end of each lateral support strut is connected to a collar that is coupled to the telescopic mast and wherein a second end of each lateral support strut is connected to respective ends of the base tube;

at least one tether line and a at least one stabilizing rod connected to the telescopic mast for stabilizing the portable discharging apparatus during the mounting and dismounting process;

wherein the telescopic mast, the base tube and the lateral support struts can be assembled in a substantially triangular shape and wherein the height of the portable installation apparatus can be adjusted to correspond to the height of the storage vessel;

c) a transportation apparatus adapted for carrying at least one portable discharging apparatus and at least one portable installation apparatus wherein the transportation apparatus is further adapted to erect the portable installation apparatus using an erecting device, wherein the erecting device comprises a rotary attachment that is adapted to mate with the proximal end of the telescopic mast and lock in an upright position.

* * * * *

UNITED STATES PATENT AND TRADEMARK OFFICE

CERTIFICATE OF CORRECTION

PATENT NO. : 7,114,575 B2
APPLICATION NO. : 10/349742
DATED : October 3, 2006
INVENTOR(S) : De Anda-Uribe et al.

It is certified that error appears in the above-identified patent and that said Letters Patent is hereby corrected as shown below:

On the title page item (57), delete "An" at the beginning of the paragraph and insert in lieu thereof -- A --;

Column 18, Line 5, delete "proximal end of the telescopic mast is removeably couplable to a top perimeter of the storage vessel", and insert in lieu thereof -- support rod can be disconnected from the support rod receptacle of the portable discharging apparatus while positioned at the top perimeter of the storage vessel, when the telescopic mast is retracted, thereby leaving only the portable discharging apparatus mounted on the top perimeter of the storage vessel. --

Column 19, Line 61, delete "attaching the vessel mounting apparatus to the upper edge of the storage vessel," and insert in lieu thereof -- disconnecting the support rod of the portable installation apparatus from the support rod receptacle of the portable discharging apparatus while positioned at the upper edge of the storage vessel, when the telescopic mast is retracted, thereby leaving the portable discharging apparatus mounted on the upper edge of the storage vessel; and --

Column 20, Line 42, delete "attaching the vessel mounting device of the second portable discharging apparatus to the upper edge of the storage vessel at a location spaced apart from the previously attached portable discharging apparatus," and insert in lieu thereof -- disconnecting the support rod of the portable installation apparatus from the support rod receptacle of the second portable discharging apparatus while positioned at the upper edge of the storage vessel, when the telescopic mast is retracted, thereby leaving the second portable discharging apparatus mounted on the upper edge of the storage vessel; and --

Signed and Sealed this

Twenty-ninth Day of July, 2008

JON W. DUDAS
*Director of the United States Patent and Trademark Office*